US011427973B2

(12) United States Patent
Pirazzini et al.

(10) Patent No.: US 11,427,973 B2
(45) Date of Patent: Aug. 30, 2022

(54) PLANT FOR THE PRODUCTION AND DISTRIBUTION OF BITUMINOUS CONGLOMERATES

(71) Applicant: MARINI S.P.A., Alfonsine (IT)

(72) Inventors: Andrea Pirazzini, Alfonsine (IT); Simona Tomba, Alfonsine (IT); Enrico Bertoni, Alfonsine (IT)

( * ) Notice: Subject to any disclaimer, the term of this patent is extended or adjusted under 35 U.S.C. 154(b) by 661 days.

(21) Appl. No.: 16/466,185

(22) PCT Filed: Dec. 6, 2017

(86) PCT No.: PCT/EP2017/001409
§ 371 (c)(1),
(2) Date: Jun. 3, 2019

(87) PCT Pub. No.: WO2018/103886
PCT Pub. Date: Jun. 14, 2018

(65) Prior Publication Data

US 2020/0141070 A1 May 7, 2020

(30) Foreign Application Priority Data

Dec. 7, 2016 (IT) ..... 102016000124444

(51) Int. Cl.
*E01C 19/00* (2006.01)
*E01C 19/10* (2006.01)
*E01C 19/05* (2006.01)

(52) U.S. Cl.
CPC ..... *E01C 19/1004* (2013.01); *E01C 19/05* (2013.01); *E01C 19/1009* (2013.01); *E01C 2019/109* (2013.01)

(58) Field of Classification Search
CPC .. E01C 19/1004; E01C 19/05; E01C 19/1009; E01C 2019/109
See application file for complete search history.

(56) References Cited

U.S. PATENT DOCUMENTS

| | | | | |
|---|---|---|---|---|
| 4,298,287 | A | 11/1981 | McCarter, III et al. | |
| 4,522,498 | A | 6/1985 | Mendenhall | |
| 7,758,235 | B1 * | 7/2010 | Collette | E01C 19/05 366/147 |
| 2015/0029809 | A1 * | 1/2015 | Brock | B28C 5/466 366/22 |

FOREIGN PATENT DOCUMENTS

| | | | |
|---|---|---|---|
| EP | 0362199 | B1 | 4/1992 |
| EP | 0641886 | A2 | 3/1995 |
| WO | 2016078755 | A1 | 5/2016 |

OTHER PUBLICATIONS

International Search Report for PCT/EP2017/001409, dated Jan. 30, 2018.

* cited by examiner

*Primary Examiner* — Anshu Bhatia
(74) *Attorney, Agent, or Firm* — Egbert, McDaniel & Swartz, PLLC

(57) ABSTRACT

Plant for the production and distribution of bituminous conglomerates and operating method of the plant, wherein the plant is provided with a dryer having a first portion and of a second portion, which are connected to each other in series one after the other.

26 Claims, 9 Drawing Sheets

PLANT FOR THE PRODUCTION AND DISTRIBUTION OF BITUMINOUS CONGLOMERATES

TECHNICAL FIELD

The present invention relates to a plant for the production of mixtures in the form of conglomerates with bituminous and non-bituminous binders provided with a dryer. The invention finds useful although not exclusive application in the production of bituminous conglomerates, in particular for road paving.

PRIOR ART

In the field of the production of mixtures in the form of conglomerates with bituminous and non-bituminous binders it is known to use a dryer for eliminating humidity from the conglomerates before their mixing with the binders to obtain the mixture in the form of conglomerates with binders, for example to obtain bituminous conglomerate, that is to say, a ready-to-use bituminous mixture, in particular for road paving.

It is also known to use reclaimed asphalt pavement, or RAP, which consists of bituminous conglomerate deriving from the milling of road pavements to be renovated and that is mixed in the plant for the production of new asphalt or bituminous conglomerate for the purpose of allowing the recycling of the reclaimed material.

The solution that represents the state of the art in the use of reclaimed material consists of a plant with a first drum on the ground for virgin aggregates or conglomerates combined with a second drum for the recycled or reclaimed material, which is placed in a parallel position with respect to the first drum.

The first drum is provided with a respective first burner for obtaining the drying of the virgin aggregates or conglomerates which are dried by means of the exposure to the flame of the first burner. The first drum and respective first burner assembly constitutes a first dryer for virgin aggregates or conglomerates.

The second drum for the reclaimed or recycled material is heated with the input of hot air. By the heating with hot air one avoids the contact between the flame of the second burner and the reclaimed or recycled material, limiting the heating of the reclaimed or recycled material to temperatures of the order of 160° C. This allows to produce asphalt at the final temperature using only recycled material. The production of hot air occurs through a second burner with a corresponding dedicated combustion chamber from which hot air at a temperature higher than 550-600° C. exits in order to obtain a better control of stack emissions. The second drum and respective second burner assembly constitutes a second dryer for reclaimed or recycled material.

In this solution of a plant provided with a first dryer for virgin aggregates or conglomerates and a second dryer for recycled or reclaimed material, the dryers are placed above the mixer so as to avoid jams of heated recycled material in the feeding chutes of the material and between the dryer and the mixer there are containment hoppers. The traditional line of a plant with sieve and hoppers is placed parallel to the dryer and the material is conveyed in the sieve through specific elevators and then in the mixer through a suitable chute. In this type of plants one tries to have as few deviations of the recycled or reclaimed material as possible to avoid problems of jamming of the latter, while preferring to use deviators only for virgin aggregates or conglomerates.

In the prior art solutions the plant is thus provided with two burners that work in the two different dryers.

In the case of the first dryer for virgin aggregates or conglomerates, the first burner has a rated power of the order of 20 MW, for example between 13 and 24 MW depending on production and on the humidity present in the material to be treated.

In the case of the second dryer for recycled or reclaimed material, the second burner has a rated power of the order of 13 MW, for example between 9 and 13 MW depending on production and on the humidity present in the material to be treated. Patent EP0362199, in the name of the same applicant, describes an apparatus for the production of bituminous conglomerate using a rotatable drying and mixing drum having a flow of combustion gas in countercurrent which is generated by means of a burner placed downstream with respect to the direction of advancement of the material to be dried. The drum is provided with means for advancing, drying, impregnating and mixing the material with bituminous substances and fillers. The drum is divided into multiple chambers communicating with each other. The burner is provided with a respective nozzle that generates a flame in a combustion chamber.

Patent application U.S. Pat. No. 4,522,498 describes an apparatus for recycling bituminous conglomerate comprising an elongated rotating drum in which the composition is introduced in a first end and recovered in the opposite second end, and having a burner which extends in the drum in such a way that the nozzle of the burner is located inside the drum in an intermediate position between the first and the second end and directs the hot gases towards the first end.

Patent WO 2016/078755, in the name of the same applicant and incorporated herein as reference, describes a dryer for a plant for the production and distribution of bituminous conglomerates comprising a suction system of air from the dryer and further provided with connecting means to a damping system of polluting compounds that are generated in the plant, wherein the damping system of polluting compounds comprises generation means of an airflow containing said polluting compounds which are drawn from different positions of the plant and are introduced in the airflow containing the polluting compounds in such a way that the polluting compounds are introduced into the dryer whose flame causes a combustion of the polluting compounds generated in the plant.

Application U.S. Pat. No. 4,298,287 describes a plant for the production of asphalt, which is provided with a continuous drum mixer in which the dust is exhausted from an intermediate zone of the drum mixer between its drying and mixing zones. The dust is exhausted radially through openings into a collection housing, which communicates with a dust collector and exhaust blower. An end housing at the discharge end of the drum communicates with the same dust collector and blower. Dampers are provided to control the relative proportion of air exhausted from the drum through the respective housings. Aggregate deflectors on the interior wall of the drum at the intermediate zone allow air and dust to flow while inhibiting the flow of aggregate. The collection housing surrounding the intermediate zone is of a size such as to produce a reduction in the velocity of the air as it passes out of the drum. Consequently, it serves as a knock-out box for the collection of larger particles which are carried out of the drum, but which settle out of the air stream as a result of the velocity decrease. These collected particles are reintroduced into the drum by scoops on the exterior of the drum. These scoops are also used for the introduction of recycled asphaltic concrete.

Application EP0641886 describes a drum for heating rock material and granular recycled asphalt having an inlet and outlet chute for the rock material and the recycled asphalt and a burner at one drum end. A large quantity of granular recycled asphalt is to be heated and added to the new rock material. The solution provides that the inlet chute for the recycled asphalt is arranged at the other drum end remote from the burner, that the outlet chute for the heated recycled asphalt is approximately arranged in the middle of the drum, that the inlet chute for the rock material is arranged after the outlet chute for the heated recycled asphalt towards the burner end of the drum and that the outlet chute for the heated rock material is arranged at the burner end of the drum.

Problems of the Prior Art

The prior art solutions based on the use of two dryers, each of which is provided with a respective burner, have high operating rated powers because the presence of the two burners easily leads to the exceedance of the power limits set by the regulations above which specific authorizations for the installation of the plant are required.

With particular reference to EP0641886, despite providing a single burner, this patent application is subject to problems with reference to the fact that it does not provide or suggest the possibility to manage the temperature of the hot air flows through the two dyers.

Furthermore the use of high power plants involves greater problems as to the polluting emissions, which are high, having to provide suitable emission damping systems dimensioned on the high rated powers of operation of the plant.

Aim of the Invention

The aim of the present invention is to provide a dryer and a plant that guarantee a reduction in the employed rated power and reduced maintenance.

Concept of the Invention

The aim is achieved by the characteristics of the main claim. The sub-claims represent advantageous solutions.

Advantageous Effects of the Invention

The solution according to the present invention, by the considerable creative contribution the effect of which constitutes an immediate and important technical progress, has various advantages.

The solution according to the present invention allows to reduce the rated power of the plant, facilitating the installation of plants according to simpler and faster authorization procedures.

The solution according to the present invention also allows to save energy in the phases of production and operation of the plant.

The solution according to the present invention also allows to reduce the release of polluting compounds into the environment during the production of mixtures in the form of conglomerates with bituminous and non-bituminous binders.

The solution according to the present invention also allows to make more compact plants reducing the occupied surface.

The solution according to the present invention also allows to use recycled materials in a flexible mode with used percentages in the final mixture of the final product which can be in the range 0 to 100%.

Furthermore, with the present invention it is allowed to provide plants with a reduced nominal used power, with a hi capacity of use of recycled materials and with reduced maintenance.

The solution according to the present invention also allows to reduce the phenomena of jamming of the material, making the plant more efficient.

Furthermore the plant integrating the solution according to the invention also allows to obtain further advantages with regard to the reduced maintenance thereof, making the plant more efficient and reducing operating costs.

The solution according to the invention, moreover, is more cost-effective due to:

- the simplification of the heat generation parts;
- the simplification of the structures for supporting the various components;
- the elimination of the direct compartment under the sieve, by direct compartment meaning a hopper that collects the material coming from the dryer, normally containing recycled material, without passing for the sieve.

DESCRIPTION OF THE DRAWINGS

In the following a solution is described with reference to the enclosed drawings, which are to be considered as a non-exhaustive example of the present invention in which.

DESCRIPTION OF THE INVENTION

Figure 1:
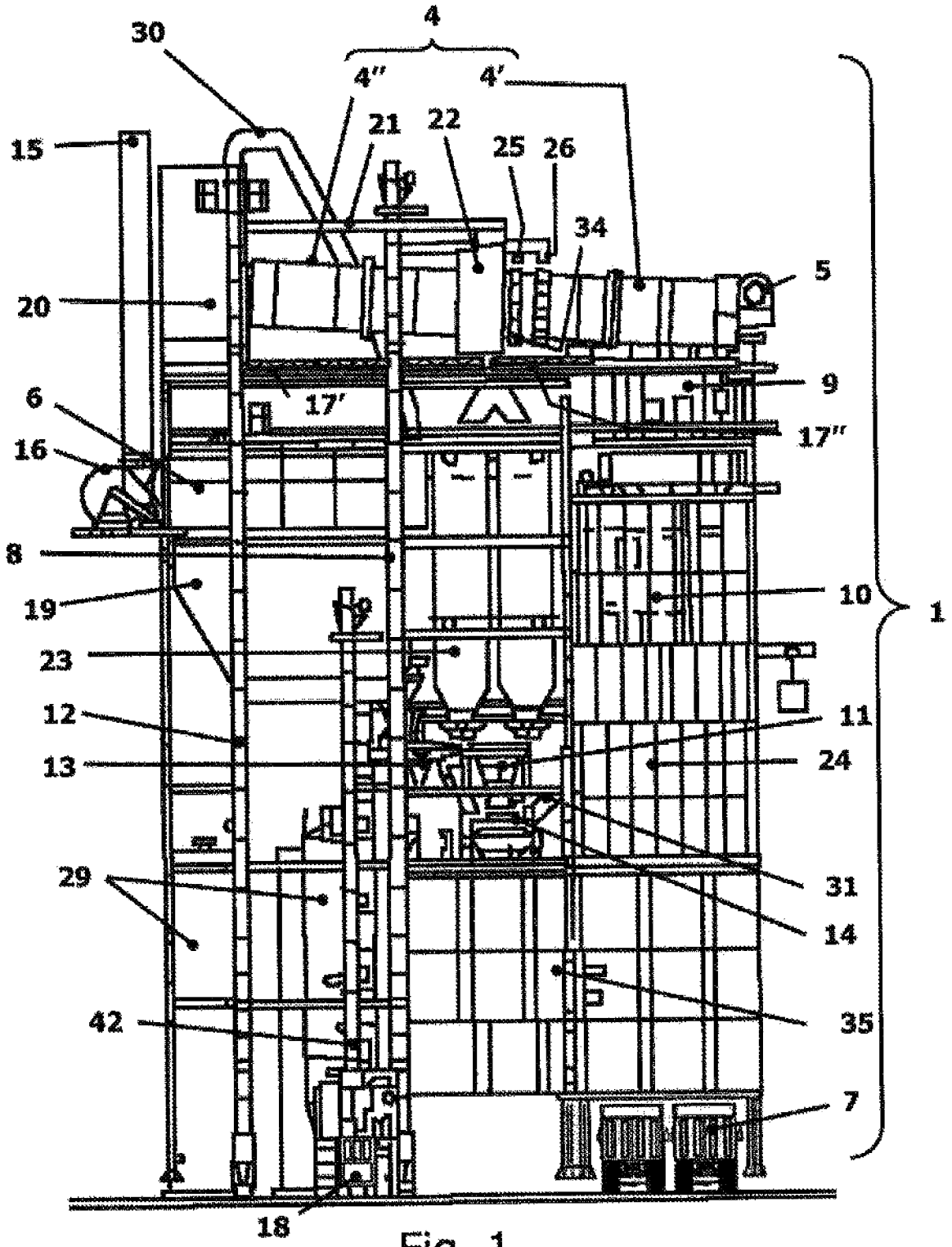
FIG. 1 represents a possible embodiment of a plant in accordance with the present invention.
Figure 2:
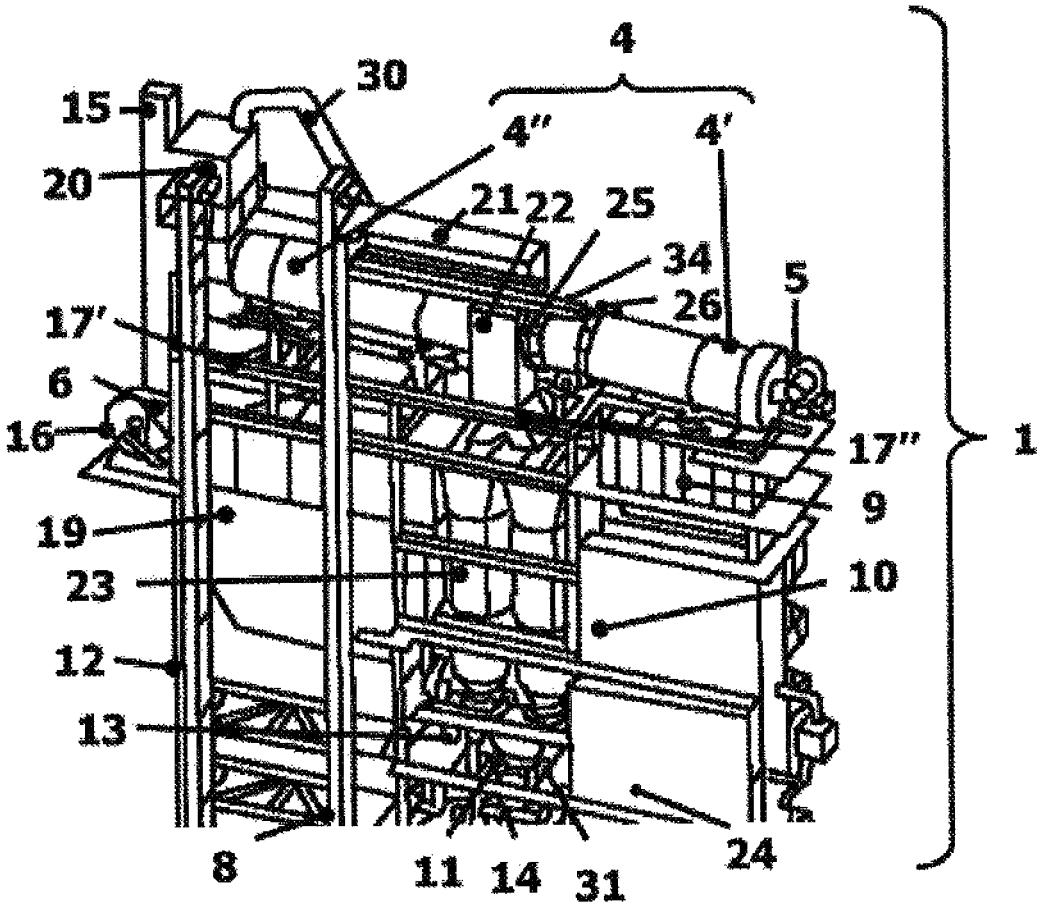
FIG. 2 represents a detail of an upper part of the plant of FIG. 1.
Figure 3:
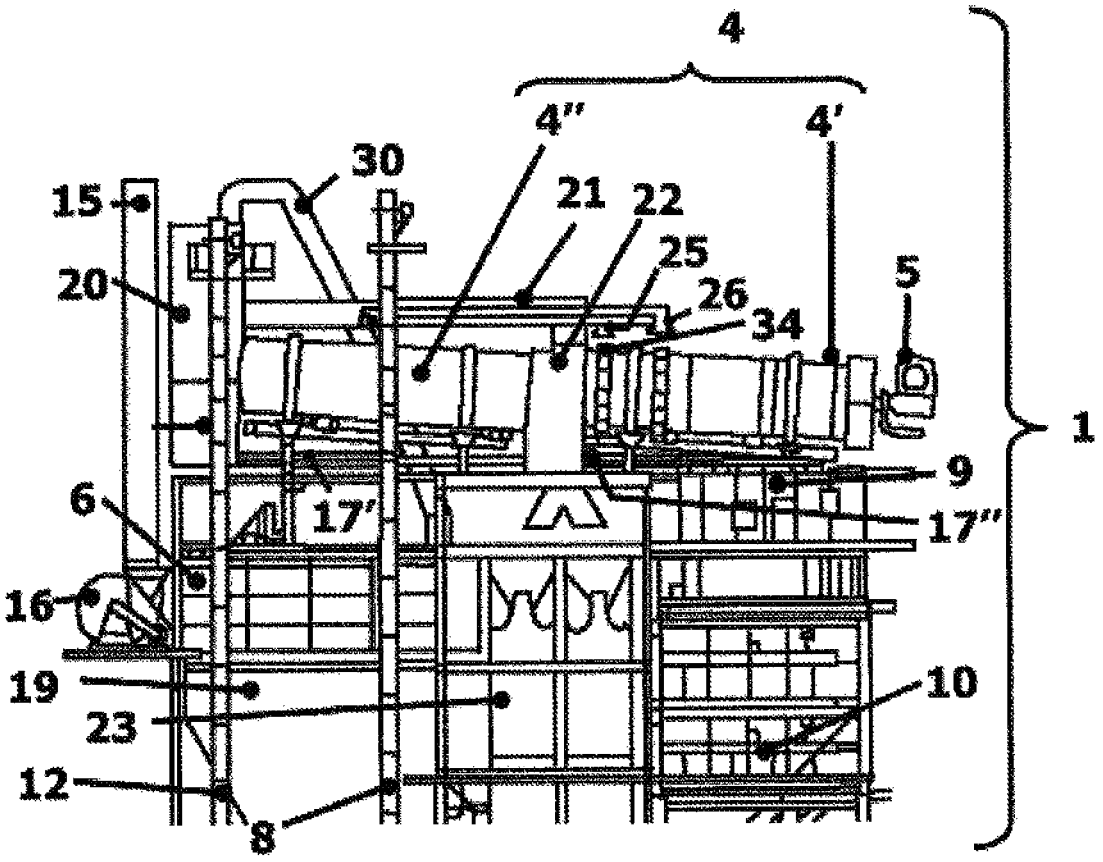
FIG. 3 represents a front view of an upper part of the plant of FIG. 1.
Figure 4:
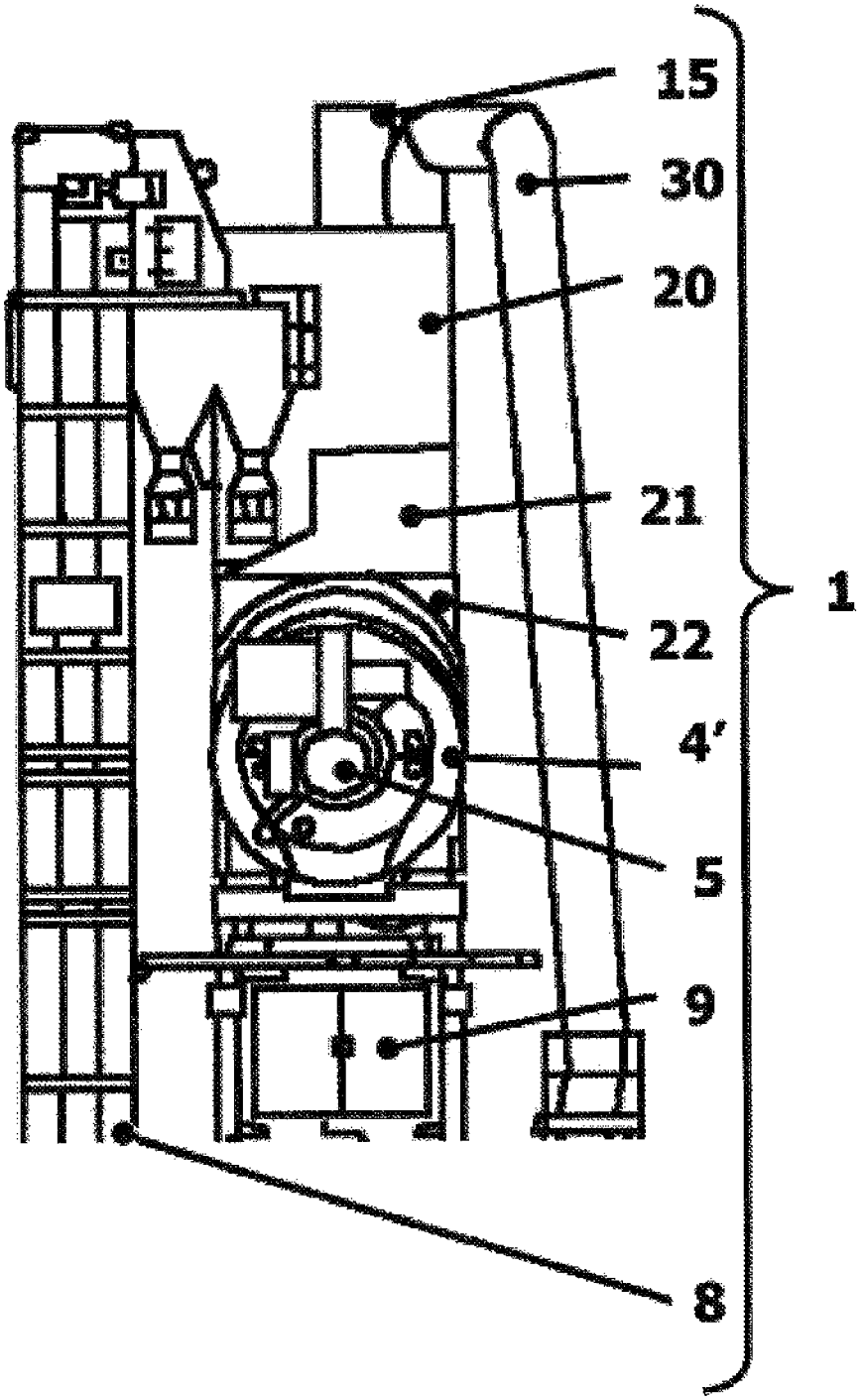
FIG. 4 represents a side view of an upper part of the plant of FIG. 1.
Figure 5:
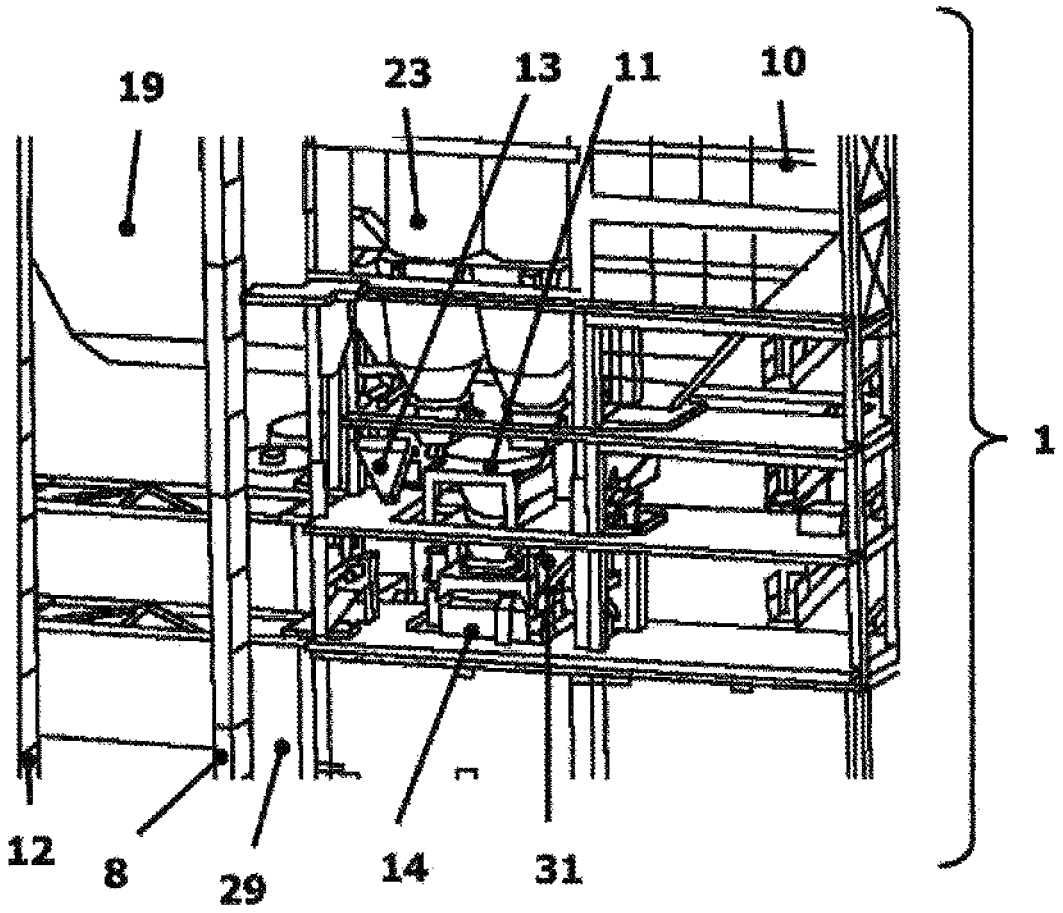
FIG. 5 represents a detail of an intermediate part of the plant of FIG. 1.
Figure 6:
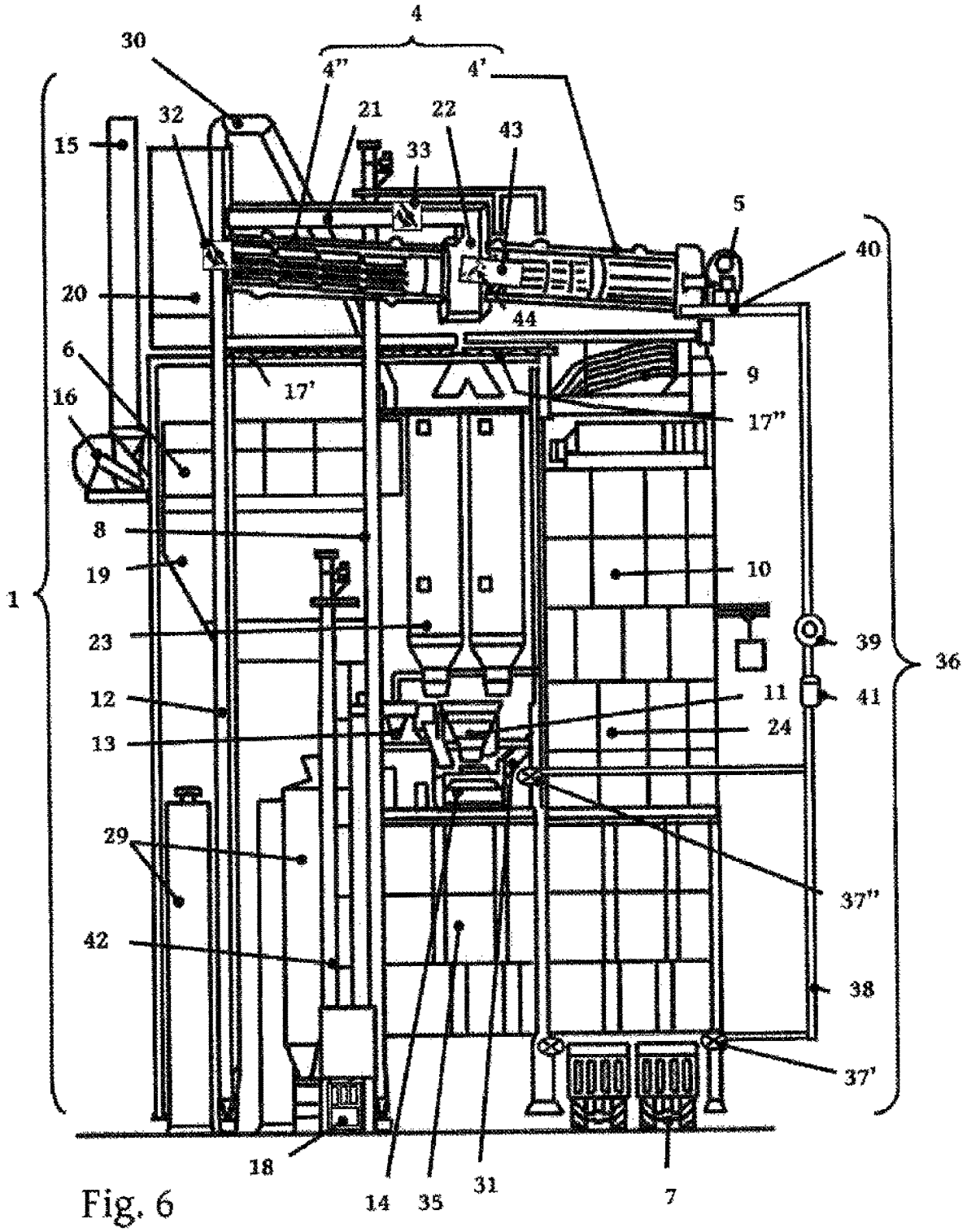
FIG. 6 schematically represents the devices present in the plant of FIG. 1.
Figure 7:
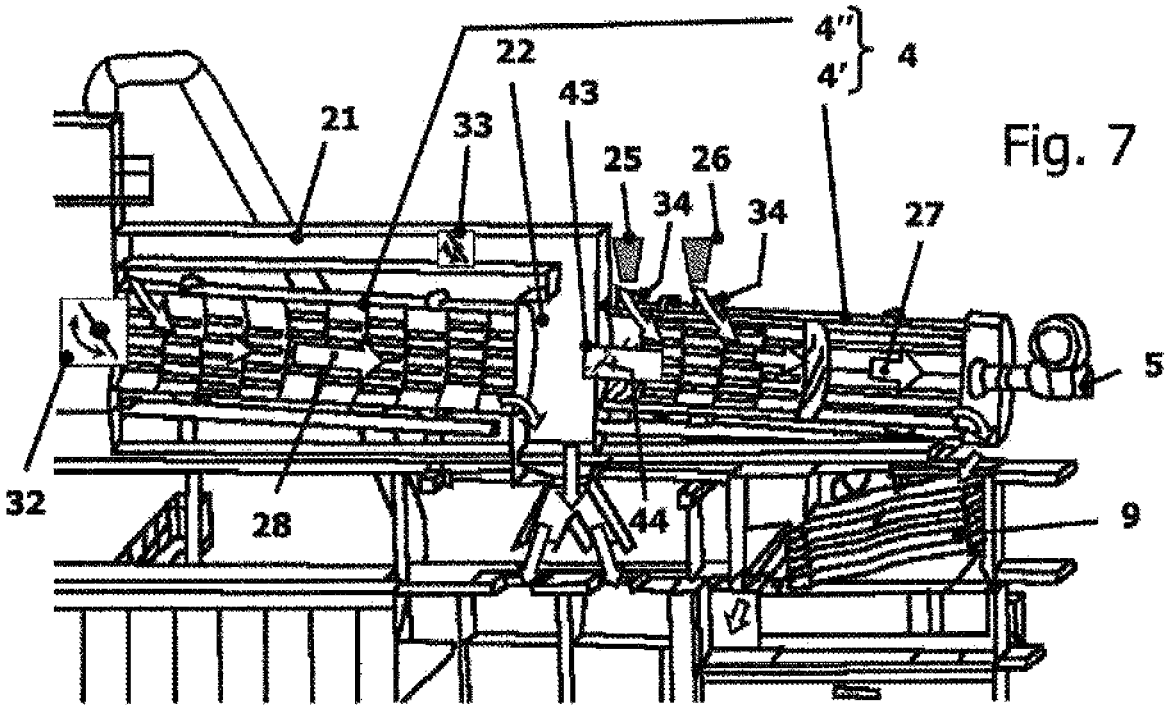
FIG. 7 schematically represents a side view partially in section of an upper part of the plant of FIG. 1.

With reference to the figures (FIG. 1, FIG. 2, FIG. 3, FIG. 4, FIG. 5, FIG. 6, FIG. 7), the present invention applies, in general, to a plant (1) for the heat preparation of mixtures in the form of conglomerates with bituminous and non-bituminous binders consisting of:

- inert materials, preferably inert lithic materials, generally gravel, of varied granulometry;
- binder, preferably bitumen, which acts as a binder of the formed mixture;

possible recycled materials, such as reclaimed asphalt pavement, or RAP, which consists of bituminous conglomerate deriving from the milling of road pavements to be renovated.

The invention finds useful, although not exclusive, application in the production of bituminous conglomerate, in particular for road paving.

The plant (1) operates according to a production cycle that occurs by means of the synchronization of a series of phases and intermediate operations. The production cycle starts with a phase of selection and feeding of the inert lithic materials. A mechanical means, generally a mechanical shovel, collects the inert lithic materials from heaps of non-selected material. The inert lithic materials are stored in different first deposit means, not shown, according to the different granulometry. For example there can be first deposit means that are distinct for inert lithic materials of small granulometry, for inert lithic materials of medium-sized granulometry, for inert lithic materials of large-sized granulometry. In this way it is possible to perform a selective feeding on the basis of the granulometry of the inert lithic materials, which can thus be sent selectively, by means of suitable pre-proportioning devices of the inert lithic materials which then supply the plant by means of conveyor means, such as extraction belts known in the art. The inert lithic materials are then subjected in the plant (1) to the following operating phases of the process, in particular a first operating phase of drying that is carried out in a dryer (4), as explained in the following of the present description. The production cycle ends with the loading of the conglomerate (FIG. 1, FIG. 6) on trucks (7) for transport. The first deposit means can be provided with suitable pre-proportioning devices for sending directly the inert lithic materials of different granulometry in the provided and correct quantities towards the devices that are located downstream with respect to the direction of advancement of the material. The first deposit means are preferably made in the form of silos or hoppers open on the upper part to enable loading and closed with openable closing means in correspondence of the bottom which is intended to allow the release of the inert lithic materials on the respective conveyor means of the inert materials which, in their turn, supply a first elevator (8) or elevator of inert materials, preferably but not necessarily in the form of a bucket elevator. It will be clear to those skilled in the art that as an alternative one can use elevators in the form of conveyor belts. In order to enable a continuous supply without interruptions of the production process, the hourly capacity of each of the first deposit means is proportional to the speed of the conveyor means or extraction belts that supply the first elevator (8) or elevator of inert materials.

For the preparation of the mixtures in the form of bituminous conglomerates, in addition to the inert lithic materials, one can also use recycled conglomerates, which are contained within second deposit means, not shown, provided with a pre-proportioning device specific for this type of material. The recycled conglomerate for example may consist of recycled asphalt products. The recycled conglomerate coming from the second deposit means, once dispensed by the pre-proportioning device can be sent to the dryer (4) by means of a second elevator (12) or elevator of inert materials to be used as heat recycled material, or can be sent directly downstream with respect to the dryer (4) to be used as cold recycled material. As an alternative, in one embodiment, in the case of the production that provides the use of cold recycled material, one can also use the plant (1) passing unheated material in the dryer, inserted in a dedicated deposit hopper for the cold recycled material.

In the case in which the recycled conglomerate is not previously divided on the basis of the granulometry, the plant (1) will have to also provide a specific sieve and a mill for reducing the size before the introduction into the plant. As an alternative, the recycled conglomerates can be previously divided on the basis of the granulometry and stored in different second deposit means, each of which is intended for a different granulometry. A control unit (18) of the production cycle automatically carries out the adjustment of capacity of each of the first deposit means and of any one or more second deposit means.

The inert lithic materials and the recycled conglomerates, if present, are sent, by means of the first elevator (8) or elevator of inert materials and the second elevator (12) or elevator of inert materials respectively, towards (FIG. 1, FIG. 6) the dryer (4) where they are heated to eliminate their humidity in a drying operating phase. The removal of humidity facilitates the coating of inert lithic materials and recycled conglomerates, if present, with the binder, i. e. bitumen. To this purpose the dryer (4) is provided (FIG. 1, FIG. 6) with a burner (5), whose operation will be explained in the following of the present description. For a regular operation of the burner (5) it is necessary to opportunely adjust a first suction system (16) of the gases produced in the dryer (4) following the combustion by the burner (5). During the drying phase the fine particles are sucked from the dryer (4) by means of the first suction system (16).

The gases produced in the dryer (4) that come out of the dryer (4) are initially conveyed in a pre-separation device (20) provided with a pre-separation compartment in which the largest particles fall to the base of the compartment and are reintroduced in the production cycle, through a reintroduction device, such as one or more cochlea devices (17', 17"), in correspondence of an outlet of the dryer (4) which is the outlet of the recycled materials or RAP or recycled conglomerates or towards the zone of passage of the outlet of the sifted inert lithic materials. The purpose of said pre-separation device is to reinsert in the process some materials necessary to obtain the correct granulometric curve and, in case of use of RAP, to reduce the harmful emissions. In fact, such larger particles contain bitumen and, by holding back the gases or fumes in the pre-separation device (20), they can be advantageously separated from the finer particles and, afterwards, reintroduced in the production cycle without harmful releases into the environment.

The gases or fumes that come out of the dryer (4) and that crossed the pre-separation device (20) are then sent (FIG. 1, FIG. 6) to a filter (6) by means of a first suction connection (30). In the dedusting filter (6) the fine dusts are damped and recovered in a filtering phase before the sucked and filtered air is released by means of fume evacuation means (15). The fine dusts are recovered in a hopper (19) positioned under the filter (6). The fine dusts recovered in the hopper (19) are weighed and proportioned prior to their use by means of (FIG. 1, FIG. 6) second weighing means (13) of fine dusts. Some formulations of mixtures in the form of bituminous conglomerates also contain, in addition to the previously described inert lithic materials and any recycled conglomerates, a given amount of fine filling material or filler. Its function consists in filling the remaining spaces between the various granulometries of inert lithic materials and recycled conglomerates. The fine filling material to be added is stored in suitable third deposit means or deposits of the filler (29). The fine filling material is taken to the level of the weighing machines by means of a third elevator (42) for fine filling material or filler, which is then weighed and proportioned prior to its use.

After crossing the dryer (4) the inert lithic materials are sent to a mixer (14) where the process for obtaining the bituminous conglomerates continues. At the outlet the dryer (4) the granulometries of the introduced inert lithic materials are mixed with each other. Sometimes it is appropriate, in order to improve their proportion, to carry out a phase of further selection of the latter with separation on the basis of the respective granulometries. To this purpose the inert lithic materials are introduced (FIG. 1, FIG. 6) in a sieve (9) that divides the inert lithic materials according to the provided sizes in a re-selection phase. Advantageously in the solution of a plant (1) according to the invention the sieve (9) is placed directly below the dryer (4) in such a way that the inert lithic materials are sent to the gravity sieve without the need to resort to further elevators or means of transport with the advantage of avoiding heat losses.

The re-selected inert lithic materials are then stored in optional buffer means, preferably in the form of buffer hoppers under the sieve (10). The buffer means, preferably a series of buffer hoppers under the sieve (10), consisting of different buffer hoppers each of which is associated with a different granulometry range, interrupt the material flow, that up to that point occurs preferably without interruptions. Each of the buffer hoppers under the sieve (10) is provided with a suitable discharge opening. The discharge openings of the buffer hoppers under the sieve (10) discharge by gravity the re-selected inert lithic materials implementing a proportioning phase in which the various granulometries are proportioned by means of third weighing means (24), preferably in the form of a weighing hopper of inert lithic materials. The third weighing means (24) or weighing hopper of inert lithic materials are placed directly under the buffer hoppers under the sieve (10).

For example the various granulometries can be introduced in sequence one after the other in third weighing means (24) made in the form of a weighing hopper suspended over loading cells carrying out a phase of proportioning based on the sum of the weighs. The feeding of the various granulometries occurs depending on the different productive formulations that one can implement. The third weighing means (24) or weighing hopper of inert lithic materials are connected to the mixer (14) by means of an exhaust (31), preferably in the form of a chute.

Meanwhile the fine dusts, previously separated by means of the dedusting filter (6) and accumulated in the hopper (19), are sent (FIG. 1, FIG. 6) to the mixer (14) by second weighing means (13), preferably in the form of a weighing hopper.

Afterwards a mixer (14) carries out (FIG. 1, FIG. 5, FIG. 6) the mixing of the various components to obtain the mixture in the form of bituminous conglomerates containing inert lithic materials, binder and filler plus any recycled conglomerates.

The binder, preferably bitumen, is proportioned by weight and is stored at a temperature that facilitates its pumping. The binder is dispensed towards the mixer (14) at a temperature that provides the best results during the phase of mixing with the conglomerate. The heating occurs by means of a thermal unit of the plant, which is separate with respect to the represented plant portion. The thermal unit consists of one or more tanks heated by corresponding one or more boilers or electrical resistors. The inert lithic materials plus any recycled conglomerates, the binder and the filler are introduced in sequence in the mixer (14) that physically makes the mixture obtaining the mixture in the form of bituminous conglomerates. In order to optimize production times, the components that will have to be introduced in the mixer (14) later are weighed while a mixing of the previously introduced components is already in progress. The so produced conglomerate can be stored directly or by means of grab buckets or transport shuttles in suitable storage and deposit means (35) in a phase of storage of the mixture in the form of bituminous conglomerates. Preferably the storage and deposit means (35) are made in the form of silos. In the described embodiment the storage and deposit means (35) are placed below the mixer (14), but in alternative embodiments the storage and deposit means (35) can also be placed laterally with respect to the main body of the schematically illustrated plant. The trucks (7), that is to say, the vehicles for the transport of the conglomerate, are refilled directly from the storage and deposit means (35) under the control of the control unit (18) under the supervision of the operator that adjusts or sets the quantity of mixture in the form of bituminous conglomerates that is released by the storage and deposit means (35).

The control unit (18) preferably enables the control of the whole production cycle by means of a management, supervision and setting system.

During the production of mixtures in the form of bituminous conglomerates and also during the loading phases on the trucks (7) it is possible to have diffuse emissions containing polluting compounds, such as organic components, normally defined as volatile organic compounds (VOCs), aromatic polycyclic hydrocarbons (APHs), etc. Advantageously it is provided that the polluting compounds are sucked preventing their release into the environment and that such polluting compounds are opportunely damped and eliminated as will be explained in the following of the present description. In particular it is provided that such polluting compounds are burnt by means of the exposure to suitable temperatures higher than 400° C., preferably higher than 600° C. In fact, it has been found that at temperatures higher than those indicated the polluting compounds are easily combustible by means of thermal oxidation if exposed to such temperatures for a sufficient period of time, of the order of a few seconds, preferably in a range between 1 and 5 seconds, even more preferably in a range between 1.5 and 2 seconds.

Figure 11:
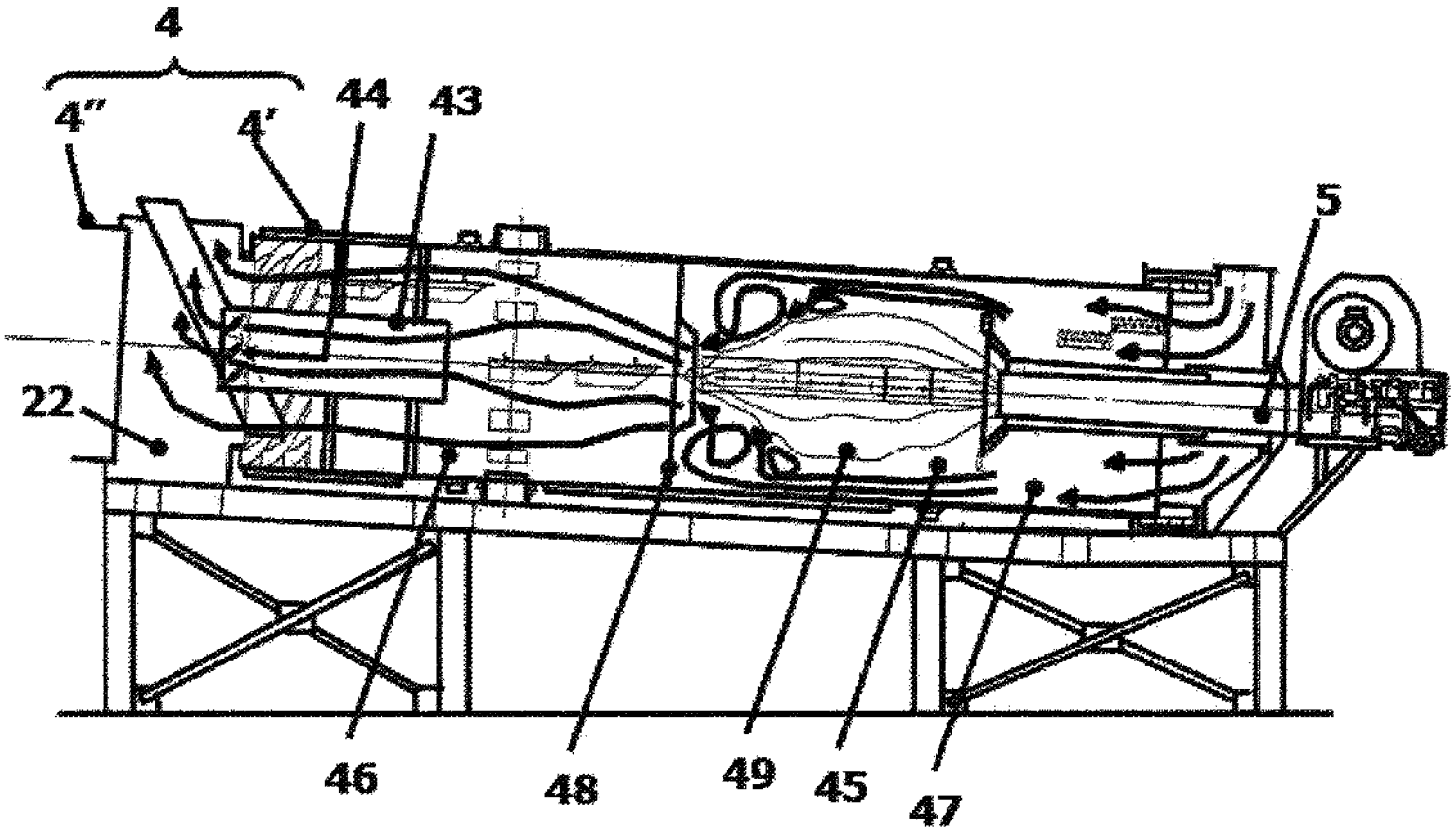
FIG. 11 shows the airflows inside a part of the dryer in accordance with the present invention.

As a consequence in the plant one can also provide an operating method that includes one or both of the following phases:

- a phase of adjustment of the combustion temperature of the polluting compounds by means (FIG. 11) of the at least one flame (49) of the burner within the dryer (4), said combustion temperature being higher than 400° C., preferably higher than 600° C.;
- a phase of slowdown of the speed of the airflow within the dryer (4), said slowdown of the speed of the airflow causing an increase in the permanence time of the polluting compounds within the dryer (4), the permanence time of the polluting compounds within the dryer (4) being preferably in a range between 1 and 5 seconds, even more preferably in a range between 1.5 and 2 seconds.

The principle of operation, in this case, provides that the polluting compounds are sucked together with the air by means of drawing or suction means from one or more zones that are subject to the presence of such polluting compounds. For example one can provide first drawing or suction means (37') in correspondence of at least one loading station of the trucks (7) in such a way as to enable the suction of the polluting compounds also during the phases of loading of the trucks (7). In order to efficiently prevent the input of the polluting compounds into the environment it can be provided that the first drawing or suction means (37') are installed according to a configuration such as to suck the air from a cabin or tunnel within which the truck (7) can enter during the loading phases. The cabin will preferably be essentially airtight in such a way that the cabin is maintained under depression by means of the first drawing or suction means themselves, thus efficiently preventing the emissions into the environment. Furthermore, for example, one can provide second drawing or suction means (37") in correspondence of the mixer (14). Furthermore, for example, one can provide third drawing or suction means in correspondence of conveyor means of the bituminous conglomerates towards the one or more storage silos as well as fourth drawing or suction means of the air with polluting compounds from the storage silos of the bituminous conglomerates.

The suction of the air with polluting compounds will preferably occur by means of a second suction system (39), distinct with respect to the first suction system (16) of air from the dryer. In practice the second suction system (39) will comprise introduction means (40) of the airflow containing the polluting compounds within the first dryer portion (4'), for example in the form of at least one second connection (38) in the form of a pipe connecting the drawing means (37', 37") or suction means to the first dryer portion (4') (4). The second suction system (39) of the air with polluting compounds comprises a respective suction fan that conveys the air with polluting compounds towards a respective filtering device (41) of the air with polluting compounds. The second suction system (39) of the air with polluting compounds is connected in such a way as to convey the air with polluting compounds towards the first dryer portion (4') of the plant (1) where there is the flame (49) of the burner (5), in particular in such a way as to convey the air in correspondence of the outlet zone of the material from the first dryer portion (4'), the airflow being oriented in countercurrent with respect to the direction of advancement (27) of the material within the first dryer portion (4').

In particular said solution, described in Patent Application UD2014A000178, in the name of the same applicant and that is incorporated as reference herein, describes, with reference to the solution as in the present application, a plant for the production and distribution of bituminous conglomerates provided with a dryer (4) wherein the first dryer portion (4') comprises (FIG. 6) at least one feeding device (25, 26) of inert lithic materials, a burner (5) generating at least one flame (49) that generates drying heat of the materials to be treated, at least one discharge head for the extraction of the treated materials from the first dryer portion (4'), a first suction system (16) of air from the dryer (4). The first dryer portion (4') is provided with connecting means to a damping system (36) of polluting compounds that are generated in the plant (1), the damping system (36) of polluting compounds comprising:

- generation means (37', 37", 39) of an airflow containing the polluting compounds which are drawn from the plant (1);
- introduction means (38, 40) of the airflow containing the polluting compounds within the first dryer portion (4') by means of an aspirator (39).

The first dryer portion (4') comprises deviation means of the airflow containing the polluting compounds which are configured to deviate the airflow towards a perimetrically external surface or shell of the first dryer portion (4'). The deviation means are configured and structured to move away the airflow at least from a generation zone of the at least one flame (49) and the deviation means are configured and structured to generate a turbulence in the airflow increasing the permanence time of the polluting compounds within the first dryer portion (4'). The at least one flame (49) of the burner (5) causes a combustion of the polluting compounds.

The deviation means of the airflow containing the polluting compounds towards the flame (49) of the burner (5) are configured and structured to convey the polluting compounds according to a conveying direction which is oriented concordantly with a direction according to which the flame (49) is oriented. Furthermore, there are adjustment means of the combustion temperature of the polluting compounds by means of the flame (49), the combustion temperature being higher than 400° C., preferably higher than 600° C.

The deviation means can for example be selected from one or more of the following:

- a deflector or section reducer preferably made of refractory steel, which facilitates the holding of the airflow with the polluting compounds in a first chamber or combustion chamber (45) of the first dryer portion (4') and further facilitates the establishment of a turbulent motion, the deflector or section reducer (48) being configured to prevent the airflow from exiting the first chamber (45);
- a screen of the airflow which is configured and structured to deviate the airflow with the polluting compounds in such a way that the airflow is directed according to a direction of advancement essentially oriented towards the zone of the flame (49) in which the temperature of the flame (49) itself is higher, that is to say, essentially in such a way that the airflow is directed towards the external part of the flame (49).

In one embodiment there can be both the deflector or section reducer and the screen according to a configuration in which they are spaced apart with respect to each other and facing each other, the screen being arranged essentially around the burner (5) in such a way as to surround at least an initial part of the flame (49) and the deflector or section reducer being arranged in an advanced position with respect to the screen, wherein the term advanced position refers to the direction of advancement of the airflow, the deflector or section reducer being placed near a zone of the first dryer portion (4') essentially corresponding to an end zone of the development of the flame (49).

The generation means of the airflow are configured and structured to adjust the airflow obtaining an airflow in a range from about 1000 to about 20000 $Nm^3/h$ of air with a constant flow rate, wherein $Nm^3/h$ refers to a measurement of the flow rate in $m^3/h$ under normal pressure and temperature conditions of 1 atmosphere and 20° C. respectively.

One can also provide adjustment or switching means of the operating power of the burner (5) between at least two different power levels of which a first power level having a lower operating power with respect to the operating power of a second power level, in which:

- the first power level is such as to cause said combustion of the polluting compounds in the absence of materials to be treated within the first dryer portion (4'), for example during phases of mere loading of the trucks (7) in the absence of production;
- the second power level is such as to cause the combustion of the polluting compounds in the presence of materials to be treated within the dryer.

For example the power of the first power level can be between about ⅙ and ⅓ of the power of the second power level, preferably the power of the first power level being between about ⅕ and ¼ of the power of the second power level.

For example the power of the first power level can be between 1.5 and 7 MW, preferably between 2 and 6 MW, even more preferably between about 2.5 and about 3.5 MW and the power of the second power level can be between 9 and 24 MW, preferably between 12 and 22 MW, even more preferably between about 15 and about 20 MW, for a production rate of about 280 tons/hour of conglomerate.

Furthermore, one can also provide a solution in which the adjustment or switching means of the operating power of the burner (5) are configured for the switching between at least three different power levels of which the previously defined first power level having a lower operating power with respect to the operating power of the previously defined second power level, and further a third power level between the first power level and the second power level, the third power level being such as to cause mainly or only the drying of the materials to be treated within the first dryer portion (4'). For example the power of the third power level is between about ⅔ and 3/3 of the power of the second power level. For example the power of the third power level is between 7 and 15 MW, preferably between 8 and 14 MW, even more preferably between about 9 and about 12 MW, for a production rate of about 140-180 tons/hour of conglomerate.

The drawing means or suction means are placed in correspondence one or more suction positions selected from:

- suction position in correspondence of a loading station of one or more road transport vehicles or trucks (7) provided with first drawing or suction means (37');
- suction position in correspondence of one or more devices for the production of the bituminous conglomerates, such as the mixer (14), wherein the devices for the production of the bituminous conglomerates are provided with second drawing or suction means (37");
- suction position in correspondence of a cover hood of transport zones of the bituminous conglomerates, the cover hood being provided with third drawing or suction means.

The suction position in correspondence of the loading station of one of said road transport vehicles or trucks (7), which is provided with first drawing or suction means (37'), is preferably made in the form of a cabin or tunnel within which one of said road transport vehicles (7) can enter to be loaded, the cabin being preferably essentially airtight in such a way that the cabin is maintained under depression by means of the first drawing or suction means.

There is also the possibility to carry out a recirculation of gases coming from the chamber of the pre-separation device (20) towards the first dryer portion (4') for their combustion in a percentage approximately from 10 to 30% with respect to the total airflow within the first dryer portion (4'), again in order to also treat the gases coming out of the second dryer portion (4") in the presence of recycled material for the reduction of pollutants and smells.

The solution of a dryer (4) according to the invention envisages the use of a dryer (4) which consists of a first portion (4') and a second portion (4") arranged one after the other with the interposition of a hot air deviation compartment (22) or hot air passage compartment. A single burner (5) is placed in correspondence of an end of the first dryer portion (4') in such a way that the air heated in the first portion (4') can be conveyed towards and into the second portion (4") through the hot air deviation compartment (22) or air passage compartment. The first dryer portion (4') constitutes the drying and heating portion for the inert lithic materials and the second dryer portion (4") constitutes the drying and heating portion for virgin materials, recycled conglomerates or recycled material or mixed materials containing variable percentages of recycled conglomerates.

In practice the dryer (4), consisting of the first portion (4') and of the second portion (4") arranged in series one after the other, is a single dryer which is suitable for the treatment both of inert lithic materials and of virgin materials, recycled conglomerates or recycled material.

The first dryer portion (4') and the second dryer portion (4"), that it so say, the dryer (4) as a whole, are provided only with one burner, preferably lower than 24 MW, preferably lower than or equal to 20 MW, below which the processes of authorization of the installation of the plant are facilitated and with further advantages in terms of energy saving of the plant.

Advantageously, since the second dryer portion (4") is not provided with a respective burner and is heated with hot air coming from the first dryer portion (4'), the recycled conglomerates or recycled material or RAP never come in direct contact with the flame (49) of the burner (5). This solution is particularly advantageous because it allows to heat the recycled conglomerates or recycled material or RAP to the necessary temperatures required by the process, of the order of 160° C., without causing the production of polluting substances of the volatile organic compound type or VOC.

In general the dryer (4) is provided with a single burner in the form of at least one burner device. This means that when, both in the description and in the claims, reference is made to at least one burner, it is intended that the previously defined single burner of the overall dryer (4) can be selected from different configurations as:

- a single burner constituted by one burner having a variable power, in which case the operating method includes an adjusting phase of the operating power of said single burner having a variable power between the different power levels defined in the present description;
- a single burner constituted by a multi-stage burner;
- a single burner constituted by a primary burner generating a main flame together with an auxiliary burner generating an auxiliary flame.

In general, for all the previously listed kinds of burners, the characteristic which must be guaranteed is the burner (5) to be provided with adjusting or switching means to be able to operate at at least two different power levels, a first power level of which having a lower operating power with respect to the operating power of the second power level. Furthermore, the first dryer portion (4') provided with the burner (5) also acts as a combustion zone for the production of hot air to be sent to the second dryer portion (4") so that the second dryer portion (4") used for the treatment of recycled conglomerates or recycled material is devoid of a burner.

Finally, when referring to a single burner, it is intended that "single" is referred to the fact that a single burner is provided for the first dryer portion (4') and the second dryer portion (4"), while the single burner can be selected from the previously defined different configurations.

The inert lithic materials, or virgin material, on the other hand, are inserted and treated in the first dryer portion (4') through feeding devices (25, 26). Advantageously it is envisaged to use two feeding devices, of which a first feeding device (25) and a second feeding device (26).

The first feeding device (25) is preferably made in the form of a chute or an annular hopper that introduces the material to be treated in the first dryer portion (4') through a first series of circumferential openings (34) that put in communication the outside of the first dryer portion (4') with the inside the first dryer portion (4') to enable the loading of the inert lithic materials, or virgin material. Preferably the first feeding device (25) is made in the form of a chute.

The second feeding device (26) is preferably made in the form of an annular hopper that introduces the material to be treated in the first dryer portion (4') through a second series of circumferential openings (34) that put in communication the outside of the first dryer portion (4') with the inside the first dryer portion (4') to enable the loading of the inert lithic materials, or virgin material.

The first series of circumferential openings (34) is positioned along the body of the first dryer portion (4') in a position that is an upstream position with respect to the position in which the second series of circumferential openings (34) is positioned, which are located downstream along the body of the first dryer portion (4'), the terms upstream and downstream being defined with respect (FIG. 7) to a direction of advancement (27) of the inert lithic materials within the first dryer portion (4').

In this way it is possible to resort to different times of treatment of the inert lithic materials keeping the other process parameters unchanged, such as the rotational speed of the first dryer portion (4') or the intensity of the flame (49) generated by the burner (5). In fact, for example as to the intensity of the flame (49) generated by the burner (5), its adjustment could be necessary according to the temperature desired in the second dryer portion (4") and, as a consequence, it is necessary to provide a different method for obtaining the desired degree of drying also in the case in which the inert lithic materials require a greater or lower exposure to the heat under conditions of constant maintenance of the intensity of the flame (49) generated by the burner (5) or also in the case in which the inert lithic materials require the same exposure to the heat under conditions of variation of the intensity of the flame (49) generated by the burner (5), said variation occurring for the purpose of modifying the temperature of the second dryer portion (4"). As a consequence, when the inert lithic materials are fed in the first dryer portion (4') by means (FIG. 7) of the first series of upstream circumferential openings (34) and of the first feeding device (25) then the inert lithic materials will be subjected to a longer treatment time within the first dryer portion (4'), while when the inert lithic materials are fed in the first dryer portion (4') by means (FIG. 7) of the second series of downstream circumferential openings (34) and of the second feeding device (26) then the inert lithic materials will be subjected to a shorter treatment time within the first dryer portion (4').

In other words, in this way one can change the permanence time of the inert lithic materials in the first dryer portion (4'), thus succeeding in modulating the heat exchange between the hot airflow generated by means of the burner (5) and the material enabling the control of the temperature in the second dryer portion (4"). One can therefore provide a process control phase in which the feeding phase of inert lithic materials within the first dryer portion (4') envisages a switching phase between a feeding condition of the materials within the first dryer portion (4') by means of the first feeding device (25) and a feeding condition of the materials within the first dryer portion (4') by means of the second feeding device (26) according to the temperature detected in a phase of measurement of the temperature in the second dryer portion (4").

Furthermore, inside the first dryer portion (4'), in the drying zone, there is (FIG. 11) a passage (43) in the form of a conduit integral with the first dryer portion (4') itself. Said passage (43) preferably has a diameter of about ⅓ with respect to the external diameter of the first dryer portion (4') and has a length preferably between ⅓ and ⅔ with respect to the length of the drying zone of the first dryer portion (4'). The purpose of said passage (43) is to put in communication the first combustion chamber (45) of the first dryer portion (4') with the second dryer portion (4") generating a preferential path for a high temperature gas flow with respect to the flow in the second chamber (46) for heating the material of the second dryer portion (4").

The first dryer portion (4') being thus intended to constitute:

a supply conduit of the hot airflow produced by the burner (5) towards the second dryer portion (4") in a condition in which materials to be treated are not present inside the first dryer portion (4');

or the portion for the treatment of the materials to be treated inside the first dryer portion (4') in a condition in which materials to be treated are not present inside the second dryer portion (4");

or both a supply conduit of the hot airflow produced by the burner (5) towards the second dryer portion (4") and the portion for the treatment of the materials to be treated inside the first dryer portion (4') in a condition in which materials to be treated are present both inside the first dryer portion (4') and the second dryer portion (4").

The passage (43) will be provided with a suitable adjustable fin or series of adjustable fins or adjustable finning (44) for opening, closing or adjustment, to be used to raise the temperature at the outlet of the first dryer portion (4').

Furthermore, the heat exchange capacity can be modified by adjusting the rotational speed of the two dryers.

In a dual mode it will also be possible to obtain an adjustment of the temperature of the hot air coming out of the first dryer portion (4') because, with the other operating conditions unchanged, when the inert lithic materials are fed in the first dryer portion (4') by means (FIG. 7) of the first series of upstream circumferential openings (34) and of the first feeding device (25) then the inert lithic materials will be subjected to a longer treatment time within the first dryer portion (4') and will absorb a greater amount of heat, while when the inert lithic materials are fed in the first dryer portion (4') by means (FIG. 7) of the second series of downstream circumferential openings (34) and of the second feeding device (26) then the inert lithic materials will be subjected to a shorter treatment time within the first dryer portion (4') and will absorb a smaller amount of heat. Therefore, in this way it is possible to change the temperature of the hot air coming out of the first dryer portion (4') which is addressed towards the second dryer portion (4") which is devoid of a respective specific burner and the control of whose temperature is very important to prevent the generation of volatile organic components as well as for the suitable preparation of the recycled conglomerates or recycled material or RAP.

Advantageously, by the solution according to the invention, also thanks to the particular described configuration of the dryer (4), the plant (1) does not require the handling of hot material through elevators because, once heated, the hot material, particularly in the case of recycled conglomerates or recycled material or RAP, is directly conveyed in the containment hoppers, thus reducing as much as possible the risk of material jamming. Moreover, the energy consumptions deriving from the need to heat the crossing chutes of recycled conglomerates or recycled material or RAP are completely avoided, the chutes for this type of material being totally absent.

The particular configuration of the dryer (4), consisting of the first portion (4') and of the second portion (4") placed one after the other, enables the treatment of recycled conglomerates with percentages ranging from 0 to 100% in weight with respect to the total weight of the treated material through a suitable combination of material introduced from respective pre-proportioning devices at the foot of the various elevators which carry the material still to be heated towards the dryer (4) for treatment. That is to say, the so structured plant can be used to treat recycled conglomerates only or variable mixtures of recycled conglomerates and inert lithic materials or inert lithic materials only, all this occurring by means of one double dryer provided with a single burner (5). In this operating mode the current ring technologies of the dryer are outdone in which the insertion of recycled material occurs through an annular hopper, normally called ring, placed in a central zone of the combustion chamber, and introduction of recycled conglomerates at the foot of the elevator of the hot material. The system, therefore, is considerably simplified, reducing the necessary components for the maximum use of recycled material. The logic of the traditional direct compartment under the sieve also disappears in which there is a compartment for receiving the dried materials without passing through the sieve, used because of the insertion of recycled conglomerates or RAP at the ring solving the maintenance problems following the jamming of the recycled material. In fact, in these cases, in the traditional plants, these hoppers are obtained as a compartment of the hopper under the sieve and inevitably have corners and changes of direction that generate jams with the recycled material. Thanks to the solution according to the invention, on the other hand, this material, containing percentages of recycled material, is introduced in dedicated hoppers specially designed for recycled material, of cylindrical shape and without corners and changes of direction.

Advantageously, the particular configuration of the dryer (4), consisting of the first dryer portion (4') and of the second dryer portion (4") arranged one after the other, allows to perform the drying treatment by means of the first dryer portion (4'), and subsequent sieving by means of the sieve (9) of the inert lithic materials or virgin material while, at the same time, the heating treatment of recycled conglomerates or RAP is performed in the second dryer portion (4").

Also thanks to the adoption of the particular configuration of the dryer (4), consisting of the first dryer portion (4') and of the second dryer portion (4") arranged one after the other, the structure of the plant (1) is modified with a complete different re-positioning of the components used that make up the traditional plant. In fact, the components of the plant are advantageously re-positioned according to a logic of optimization of the occupied space, with a reduction of heat dispersions and avoiding handling and lifting means for the dried or heated materials, the handling and lifting means being, therefore, limited only to the transport of the materials to be treated and not heated. In fact, the recycled conglomerates or RAP, once heated by means of the second dryer portion (4"), are directly conveyed into the respective storage hoppers or second deposit means (23) for recycled conglomerates or RAP. The containment line of the material with recycled material starting from the storage hoppers or second deposit means (23) for recycled conglomerates or RAP up to the discharge into the mixer must guarantee the maintenance of temperature, therefore said containment line will be preferably insulated and/or heated, according to solutions known in the art. Furthermore, the inert lithic materials, once dried by means of the first dryer portion (4'), are directly conveyed onto the sieve (9). The fine dusts recovered from the filter (6) are also directly stored under the filter (6) in the hopper under the filter (19) by gravity and are thus introduced into the weighing hopper before being fed into the mixer (14).

The adjustment of the heating temperature of the recycled conglomerates or RAP can occur according to new operating logics as well. For example in one of the possible operating modes it can be provided that the adjustment of the heating temperature in the second dryer portion (4") occurs by adjusting the quantity of inert lithic materials or by adjusting the position of introduction of the inert lithic materials in the first dryer portion (4'), the latter solution being made possible by the adoption of the configuration of the first portion (4') which is provided with the previously described first series of upstream circumferential openings (34) fed by the first feeding device (25) and second series of downstream circumferential openings (34) fed by the second feeding device (26), as previously explained.

In the case of mixed materials containing a quantity of recycled conglomerates above a given percentage, it is possible to feed directly the second dryer portion (4") with a mixture of recycled conglomerates and virgin material. The percentage of recycled conglomerates above which one can use this operating method can depend on various factors like humidity and type of production and, for example, can be of the order of percentage of recycled conglomerates higher than 50% with respect to the total of the mixture of recycled conglomerates and virgin material.

The larger-sized material or larger particles present in the fumes or gases sucked from the dryer (4), as previously explained, contain bitumen. For this reason, both for the purpose of preventing their dispersion and for the purpose of preventing the clogging or damage of the filter (6), such larger particles present in the fumes or gases are damped by means of a pre-separation device (20) provided with a pre-separation compartment in which the larger particles fall to the base of the compartment. The pre-separation device (20) is placed in correspondence of the outlet of the fumes or gases from the dryer (4). The so separated and collected larger-sized material or larger particles can be conveyed into the containment hoppers of the recycled conglomerates or RAP by means of a first cochlea device (17'), in the case in which the recycled material is being heated, or can be conveyed, by means of a second cochlea device (17"), into the chute of the sieve in the case in which only inert lithic material or virgin material is being heated.

Figure 8:
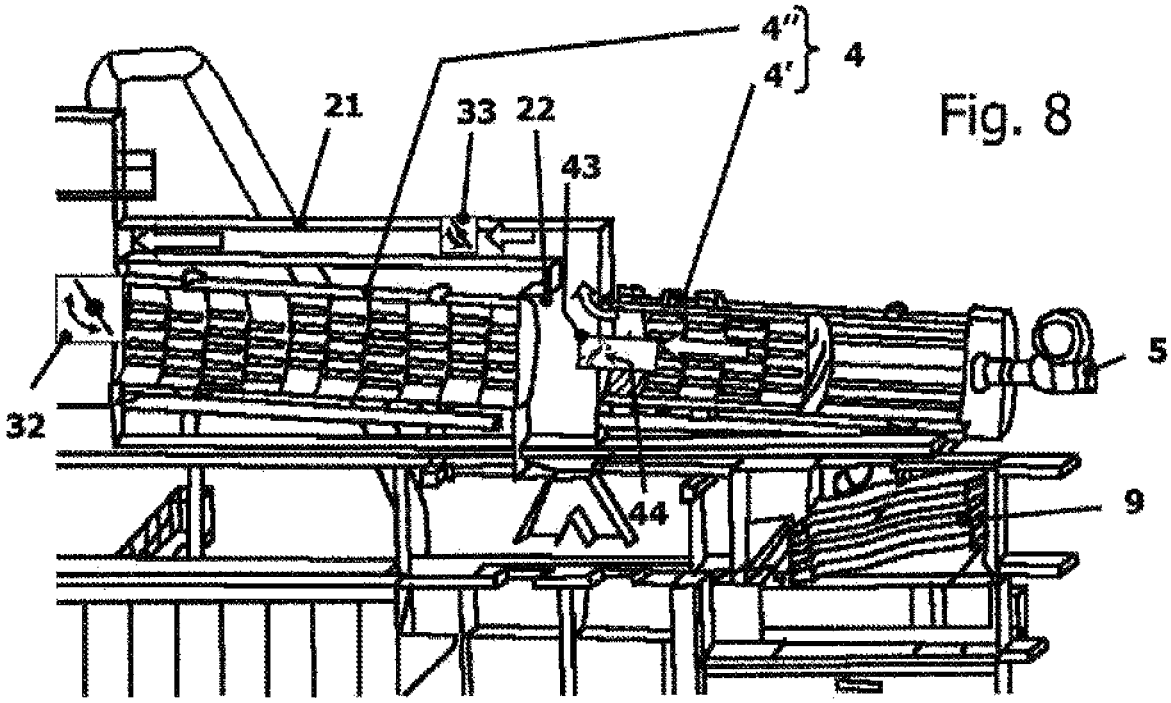
FIG. 8 shows one of the operating modes of a plant in accordance with the present invention.
Figure 9:
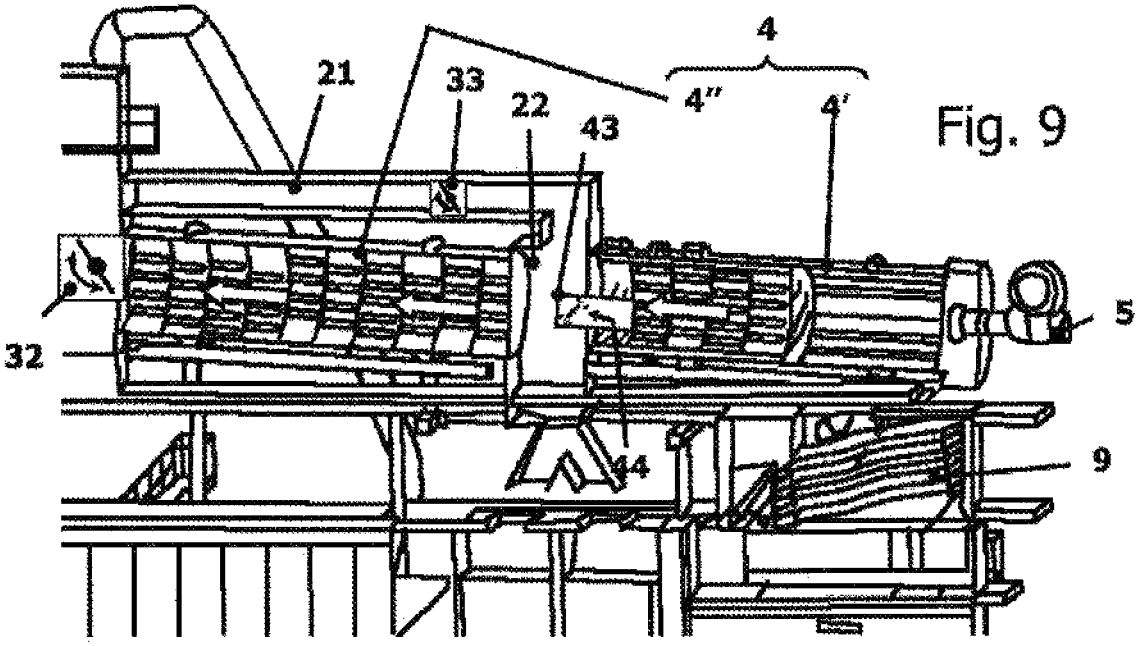
FIG. 9 shows another of the operating modes of a plant in accordance with the present invention.
Figure 10:
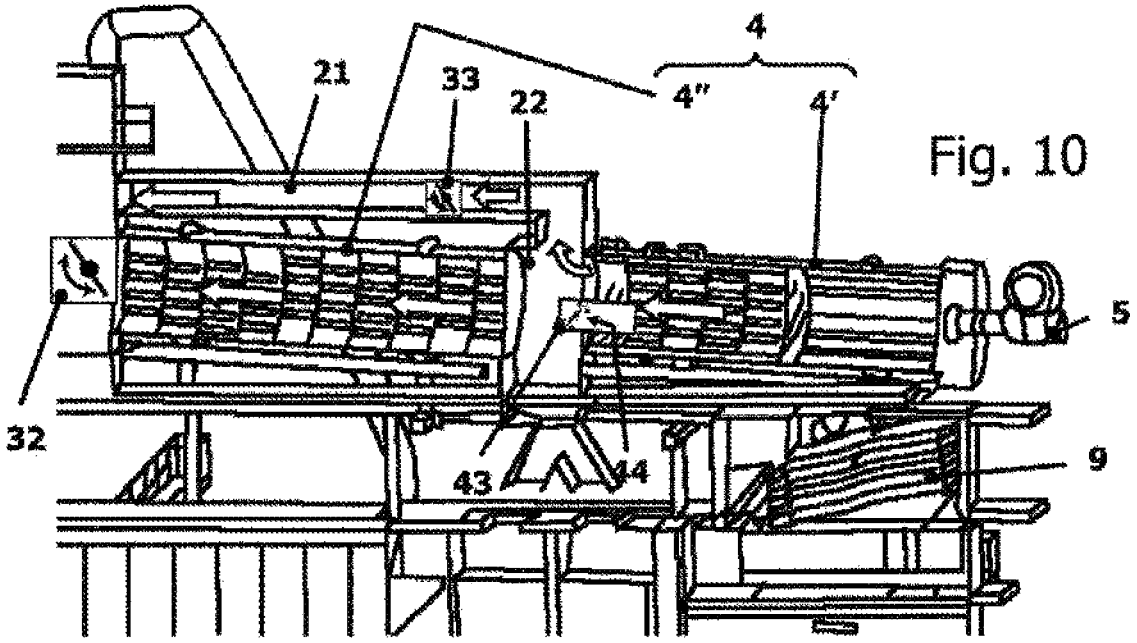
FIG. 10 shows still another of the operating modes of a plant in accordance with the present invention.

From everything described above one will understand that the plant (1) comprising the dryer (4), consisting of the first dryer portion (4') and of the second dryer portion (4") arranged one after the other, can work according to different operating modes of which:

- a first operating mode (FIG. 10) in which the single burner (5) of the dryer (4) produces heat both for the treatment of the inert lithic materials fed in the first dryer portion (4') and for the treatment of the recycled materials or RAP fed in the second dryer portion (4"), the heat supplied to the second dryer portion (4") being supplied by means of the hot drying air extracted from the first portion (4') within which the inert lithic materials or virgin materials are treated;

a second operating mode (FIG. 8) in which the single burner (5) of the dryer (4) produces heat only for the treatment of the inert lithic materials fed in the first dryer portion (4');

a third operating mode (FIG. 9) in which the single burner (5) of the dryer (4) produces heat only for the treatment of the recycled materials or RAP fed in the second dryer portion (4"), the heat supplied to the second dryer portion (4") being supplied by means of the hot drying air extracted from the first portion (4') within which no treatment of the inert lithic materials or virgin materials occurs, in this case the first portion (4') acting as a feeding conduit of the hot air produced by the burner (5).

In the case in which the plant (1) is working in the second operating mode of treatment of the inert lithic materials fed in the first dryer portion (4') only, the second dryer portion (4") can remain completely unused and the fumes extracted from the first dryer portion (4') can be conveyed by means of a suction conduit (21) directly to the pre-separation device (20) and, afterwards, to the filter (6).

It is provided that the circuit of conveyance of the hot air or fumes extracted from the first dryer portion (4') comprises at least one, preferably two shutters (32, 33) for the deviation or partialization or control of the hot airflow or fumes coming out of the first dryer portion (4').

In the operation of the first or third operating mode it is possible that, by effect of the heat exchange with the recycled material, the gases coming out of the second dryer portion (4") in the conduit towards the filter are at less than 100° C. Through the shutters (32, 33) it will also be possible to adjust the temperature in such a way that said temperature is not lower than 100° C. to ensure a suitable heating of the air and not fall below the dew point.

In the operation of the first or third operating mode it is necessary that the temperature of the gases coming out of the first dryer portion (4') is sufficient to ensure a suitable heating of the recycled materials or RAP. Through such shutters (32, 33) it will be possible to adjust the temperature inside the second dryer portion (4") for example by measuring the temperature of the hot air or fumes coming out of the second dryer portion (4") and, for example, acting on the shutter or on the shutters in such a way that this temperature is not lower than 100° C. to ensure a suitable heating of the recycled materials or RAP.

The first dryer portion (4') is in its turn divided into two main zones of which a first zone constitutes a first chamber or combustion chamber (45) in which the flame (49) of the burner (5) develops and of which a second zone constitutes a second chamber or drying chamber (46). Before the combustion chamber there is also a pre-chamber (47). The first chamber or combustion chamber (45) is provided with suitable blades for holding the material avoiding a rain-like fall of the latter through the flame (49) produced by the burner (5).

The second chamber or drying chamber (46) is provided with suitable blades which are intended to generate a rain-like fall of material as widespread as possible in the section, in such a way as to enable and optimize the heat exchange between the material and the hot air coming from the first chamber or combustion chamber (45).

The feeding of the inert lithic materials or virgin material occurs through the previously described first feeding device (25) and second feeding device (26) according to the configuration in which the first feeding device (25) feeds a first series of upstream circumferential openings (34) while the second feeding device (26) feeds a second series of downstream circumferential openings (34), the terms upstream and downstream being defined with respect (FIG. 7) to a direction of advancement (27) of the inert lithic materials within the first dryer portion (4').

The first feeding device (25) is placed in correspondence of or in proximity to a head end of the second chamber or drying chamber (46).

The second feeding device (26) is placed spaced apart with respect to the first feeding device (25) according to the direction of advancement of the material, the second feeding device (26) being placed in correspondence of or in proximity to a position between the head end of the second chamber or drying chamber (46) and the outlet end of the second chamber or drying chamber (46), indicatively placed in the centreline of the combustion chamber.

Preferably the first feeding device (25) and the second feeding device (26) are spaced apart with respect to each other by a distance between 25% and 75% with respect to the overall length of the second chamber or drying chamber (46) of the first dryer portion (4'). For example the first feeding device (25) and the second feeding device (26) can be spaced apart from each other by a distance between 1 with 3 metres, preferably about 2 metres.

As a consequence, for the desired effects of increase in the temperature at the outlet of the first dryer portion (4') and of reduction in the heat exchange with the virgin materials, one can resort to one or more from:

switching of the feeding between the first feeding device (25) and the second feeding device (26);

management of the gas flow between the first dryer portion (4') and the second dryer portion (4") by means of the air deviation compartment (22) or air passage compartment provided with shutters (32, 33).

As to the production process, the plant (1) can implement the operating phases of a traditional plant but with new specific phases deriving from the adoption of the previously described configuration of the dryer (4) consisting of the first dryer portion (4') and of the second dryer portion (4") arranged one after the other and further deriving from the particular arrangement deriving from the use of said dryer (4) placed at the top of the plant (1) itself.

With reference to the inert lithic materials, the latter are dispensed from first deposit means of the inert lithic materials and, by means of suitable pre-proportioning devices of the inert materials, the inert lithic materials are conveyed to a first elevator (8) of inert materials which is preferably made in the form of a bucket elevator. The first elevator (8) of inert materials carries the inert lithic materials towards the top of the plant (1) and supplies a buffer hopper. Two belts start from the buffer hopper and supply the first feeding device (25) and the second feeding device (26).

The first feeding device (25) is preferably made in the form of an annular hopper or chute that introduces the material to be treated into the first dryer portion (4') through a first series of circumferential openings (34) that put in communication the outside of the first dryer portion (4') with the inside of the first dryer portion (4') to enable the loading of the inert lithic materials, or virgin material.

The second feeding device (26) is preferably made in the form of an annular hopper that introduces the material to be treated into the first dryer portion (4') through a second series of circumferential openings (34) that put in communication the outside of the first dryer portion (4') with the inside of the first dryer portion (4') to enable the loading of the inert lithic materials, or virgin material.

The first series of circumferential openings (34) is placed along the body of the first dryer portion (4') in a position that is an upstream position with respect to the position in which the second series of circumferential openings (34) is placed, which are located downstream along the body of the first dryer portion (4'), the terms upstream and downstream being defined with respect (FIG. 7) to a direction of advancement (27) of the inert lithic materials within the first dryer portion (4').

The power of the burner (5) is modulated according to the desired output temperature of the inert lithic materials. The hot air or fumes exit the first dryer portion (4') and are conveyed in an air deviation compartment (22) or air passage compartment that in its turn is connected to the second dryer portion (4") and also to a suction conduit (21).

The airflow passing through the air deviation compartment (22) or air passage compartment is controlled by means of:

- a first shutter (32) of block or deviation or partialization of the airflow which is placed (FIG. 6, FIG. 7, FIG. 8, FIG. 9, FIG. 10) in a conduit of the fumes that puts in communication the second dryer portion with the filter (6);
- a second shutter (33) of block or deviation or partialization of the airflow which is placed (FIG. 6, FIG. 7, FIG. 8, FIG. 9, FIG. 10) within the suction conduit (21).

In a less preferred solution of the present invention the first shutter (32) of block or deviation or partialization of the airflow can be placed within or in correspondence of or in proximity to the air deviation compartment (22) or air passage compartment.

The shutters (32, 33), that is to say, the first shutter (32) and the second shutter (33) can be controlled in such a way as to:

- allow the flow of all the air or fumes from the first dryer portion (4') to the second dryer portion (4"), completely blocking the airflow or fumes from the first portion (4') to the suction conduit (21);
- completely block the flow of air or fumes from the first dryer portion (4') to the second dryer portion (4") deviating the airflow or the fumes from the first dryer portion (4') to the suction conduit (21);
- partialize the flow of air or fumes from the first dryer portion (4') in such a way as to divide it and send a part of it to the second dryer portion (4") and another part or the remaining part to the suction conduit (21).

In the case in which the dryer (4) operates in the previously defined second operating mode in which the single burner (5) of the dryer (4) produces heat only for the treatment of the inert lithic materials fed in the first dryer portion (4'), then the second dryer portion (4") will be idle and non-operating. The first dryer portion (4') is fed by the first feeding device (25) or primary feeding device that introduces the inert lithic materials into the second chamber (46) of the first dryer portion (4'), in order to optimize the drying and heating process of the inert lithic materials. The inert lithic materials are then conveyed and cross the first chamber (45) of the first dryer portion (4') and finally exit at the end of the first chamber (45). By gravity the inert lithic materials are introduced into the vibrating sieve (9). In the second operating mode the first shutter (32) is set in such a way as to completely block the flow of air or fumes coming from the second dryer portion towards the filter (6) so that the flow of air or fumes from the first dryer portion (4') to the second dryer portion (4") is consequently blocked, thus obtaining the deviation of the flow of air or fumes from the first dryer portion (4') to the suction conduit (21). In the second operating mode the second shutter (33) is set in such a way as to allow the flow of air or fumes from the first dryer portion (4') to the suction conduit (21), that is to say, it is preferably completely open. Any larger-sized material or larger particles present in the fumes or gases sucked from the dryer (4), as previously explained, are damped by means of the pre-separation device (20) and the so separated and collected larger-sized material or larger particles are preferably conveyed, by means of the second cochlea device (17"), into the chute of the sieve (9). The materials coming out of the pre-separator are, in general, conveyed to the sieve (9) to reintegrate the granulometric composition of the formula.

In the case in which the dryer (4) operates in the previously defined first operating mode in which the single burner (5) of the dryer (4) produces heat both for the treatment of the inert lithic materials fed in the first dryer portion (4') and for the treatment of the recycled materials or RAP fed in the second dryer portion (4"), then the configuration of the shutters is suitably modified as the heat supplied to the second dryer portion (4") must be supplied by means of the hot drying air extracted from the first portion (4'). In this case, therefore, the first shutter (32) is set in such a way as to allow the flow of air or fumes from the second dryer portion (4") towards the filter (6), that is to say, it is set in such a way as to allow the flow of air or fumes from the first dryer portion (4') to the second dryer portion (4"), that is to say, the first shutter (32) is in the open position. The second shutter (33), on the other hand, is set in such a way as to block the flow of air or fumes from the first dryer portion (4') to the suction conduit (21), that is to say, the second shutter (33) is in the closed position. In this case the quantity of inert lithic materials that are fed towards the first dryer portion (4') is also reduced in such a way that there is a lower absorption of the heat produced by the burner (5) in the first dryer portion (4') and a greater amount of heat is extracted from the first dryer portion (4') by means of the suction of the hot air or fumes from the first dryer portion (4') to be sent towards the second dryer portion (4") which thus receives a greater amount of heat necessary for the treatment of the recycled materials or RAP. That is to say, by reducing the quantity of inert lithic materials that are fed towards the first dryer portion (4'), one obtains a rise in the temperature of the air coming out of the first dryer portion (4') and a consequent rise in the temperature of the air coming into the second dryer portion (4"). The recycled material or RAP starts to transit inside the dryer (4) and crosses the second dryer portion (4") being consequently subjected to a drying and heating phase. Downstream of the first shutter (32) there is a first temperature probe, the term downstream referring to the direction of advancement of the hot air or fumes from the first dryer portion (4') to the second dryer portion (4"). The first temperature probe measures the temperature of the hot air or fumes at the inlet of the second dryer portion (4"). To facilitate the rise in or the maintenance of the temperature in the second dryer portion (4"), particularly in the phases of start of the treatment of recycled materials or RAP, when the treatment of inert lithic materials is in progress, the feeding of inert lithic materials in the first dryer portion (4') is progressively shifted from the first feeding device (25) to the second feeding device (26), in such a way as to enable the rise in the temperature of the air or fumes coming into the second dryer portion (4"). In fact, moving the feeding zone of the inert lithic materials in the downstream position corresponding to the second feeding, device (26), the inert lithic materials transit within the first dryer portion (4') for a smaller section with a shorter crossing time and, in this way, absorb less heat thus causing the desired rise in the temperature of the air or fumes that enter the second dryer portion (4") where the treatment of the recycled materials or RAP occurs. Preferably the temperature of the air or fumes entering the second dryer portion (4") is maintained at a temperature of the order of 500-600° C.

The intervention modes will obviously have to occur in accordance with productions compatible with the final temperature of the two products coming out of the first and of the second dryer portions, in accordance with the humidity of the recycled and inert materials and with the percentages of use of the recycled material with respect to the virgin material.

Considering an operating example with a burner having a maximum power of 20 MW in which both the first dryer portion (4') and the second dryer portion (4") are in operation, this is the case requiring the maximum generation of heat possible. The heat balance relating to the heating of the material in the first dryer portion (4') and of the material in the second dryer portion (4") should thus be congruent with the amount of heat necessary for heating both the material in the first dryer portion (4') and the material in the second dryer portion (4"). In general, considering a humidity of 3% and the burner working at 13 MW with an output temperature of the material at 160° C., the expected production can be for example of the order of 200 t/h which can be distributed in a percentage from 10 to 70% and preferably about 50% between the first dryer portion (4') and the second dryer portion (4").

The shift of the feeding of inert lithic materials from the first feeding device (25) to the second feeding device (26) also allows to avoid the overheating of the inert lithic materials themselves, for which one must maintain the desired temperature at the outlet of the first dryer portion (4'), that is to say, at the inlet of the second dryer portion (4").

Additionally or alternatively, in order to reach the temperatures necessary for the heating of the material in the second dryer one can act by opening the internal passage (43) in the first dryer by means of the movable fins (44), modifying the rotational speed of the first dryer and activating the row of movable blades inside it according to different opening or closing positions to obtain an adjustment of the flow.

Once the desired temperature of the hot air or fumes has been reached at the inlet of the second dryer portion (4"), the feeding of the recycled material or RAP in the second dryer portion (4") is continued.

The output temperature of the recycled material or RAP from the second dryer portion (4") can be adjusted or set by means of the control of the flow rate of the recycled material or RAP introduced into the second dryer portion (4"), rotational speed of the second dryer portion (4"), flow rate of the hot air or fumes conveyed within the second dryer portion (4") and coming from the first dryer portion (4'), adjustment of the power of the burner.

The hot air or fumes coming out of the second dryer portion (4") are introduced into the pre-separation device (20) for the separation of the larger particles from the fine dusts. The larger particles, indicatively between 0.1 and 3 mm, fall to the base of the pre-separation device (20) and are reintroduced through one or more cochlea devices (17', 17") as previously explained. In the case in which the dryer (4) operates in the previously defined first operating mode in which the single burner (5) of the dryer (4) produces heat both for the treatment of the inert lithic materials fed in the first dryer portion (4') and for the treatment of the recycled materials or RAP fed in the second dryer portion (4"), then, preferably, the larger particles recovered in the pre-separation device (20) are reintroduced along with the recycled material or RAP at the outlet of the second dryer portion (4"). Such particles should be recovered and eliminated before the filter (6) because they contain bitumen. The temperature of the hot air or fumes coming out of the second dryer portion (4") is measured by means of a second temperature probe placed in the connecting conduit between the filter (6) and the pre-separation device (20). If the measured temperature is lower than the dew point, typically of the order of 100° C., to prevent damaging the filter (6), it is provided that control means, for example controlled by means of the control unit (18), intervene to open the second shutter (33) partially, in such a way as to draw a given amount of air at a higher temperature coming out of the first dryer portion (4'). In practice a partialization of the airflow coming out of the first dryer portion (4') is carried out in such a way that:

- a first part of the airflow coming out of the first dryer portion (4') is addressed into the second dryer portion (4");
- a second part of the airflow coming out of the first dryer portion (4') is addressed into the suction conduit (21) bypassing the second dryer portion (4").

The first part of the airflow and the second part of the airflow are both fed in the pre-separation device (20) within which they are mixed, thus being able to adjust the temperature of the overall airflow at the inlet of the filter (6).

In the case in which the use of the sieve (9) is not required and above certain percentages of recycled material or RAP one resorts to the previously defined third operating mode in which the single burner (5) of the dryer (4) produces heat only for the treatment of the recycled materials or RAP fed in the second dryer portion (4"), the heat supplied to the second dryer portion (4") being supplied by means of the hot drying air extracted from the first dryer portion (4') within which no treatment of inert lithic materials or virgin materials occurs, in this case the first portion (4') acting as a feeding conduit of the hot air produced by the burner (5). In this case the first dryer portion (4') is kept in rotation and acts only as a combustion chamber. A suitable third temperature probe monitors the external temperature of the shell of the first dryer portion (4') for the purpose of preventing any overheating within the first dryer portion (4'). In case of overheating it is possible to reduce the power of the burner (5) and if necessary also to turn it off. As an alternative, in combination with the reduction of the power of the burner (5), one can also adopt further measures for obtaining the reduction in the temperature in the first dryer portion (4'), for example by providing an increase in the airflow sucked from the first dryer portion (4') acting on the first suction system (16), or providing an increase in the flow of recycled material within the second dryer portion (4") in combination with an increase in the airflow within the second dryer portion (4") to increase the amount of heat transferred from the first dryer portion (4').

In general, both for the first operating mode and for the third operating mode, the treated recycled material or RAP is discharged from the second dryer portion (4") and is conveyed into deposit means (23) of the treated recycled material or RAP, for example in the form of one or more storage hoppers. Advantageously the deposit means (23) of the treated recycled material or RAP are placed in the plant (1) directly above the first weighing means (11), which, in their turn, are placed immediately above the mixer (14).

With reference to the second dryer portion (4"), in the case in which the inert lithic materials do not have to be sifted, one can also provide an additional operating mode in which the second dryer portion (4") is simultaneously supplied with inert lithic materials and recycled material or RAP. In this case in the elevator that feeds the second dryer portion (4") recycled material or RAP and inert lithic materials are simultaneously inserted. Therefore the second dryer portion (4") can treat material consisting of 100% recycled material or RAP or lower percentages of recycled material or RAP in which the remaining portion consists of inert lithic materials.

The inert lithic materials, on the other hand, are discharged from the first dryer portion (4') and are sent to the sieve (9). After the sieving phase operated by means of the sieve (9), the sifted inert lithic materials are sent into different buffer means (10) or hoppers under the sieve according to the respective sifted size. Each of the buffer means (10) or hoppers under the sieve is provided with a suitable discharge opening that discharges within third weighing means (24) of inert lithic materials, for example in the form of a weighing hopper. The third weighing means (24) of inert lithic materials are placed directly under the buffer means (10) or hoppers under the sieve. The third weighing means (24) of inert lithic materials discharge the measured or weighed inert lithic materials into an exhaust or chute (31) that feeds the mixer (14).

In one embodiment one can also provide a plant (1) devoid of the sieve (9). In said variant the sieve (9) is replaced by a chute for inert materials provided with deflectors which allow the deviation of the material in such a way as to selectively load several distinct compartments in which each compartment is intended to contain a different produced mixture containing inert lithic materials of different granulometry that have been previously selected and pre-proportioned before being fed in the plant (1).

By the described logic of arrangement of the components it is possible to avoid the chutes crossed by material containing recycled material, using them instead in the presence of the inert lithic material only. This obviously involves a reduction in jamming and therefore in maintenance, besides eliminating the need to heat the chutes with further benefits in terms of energy saving.

To conclude (FIG. 1, FIG. 2, FIG. 3, FIG. 4, FIG. 5, FIG. 6, FIG. 7, FIG. 8, FIG. 9, FIG. 10) the present invention relates to a plant (1) for the production and distribution of bituminous conglomerates comprising at least one dryer (4) for drying materials to be treated, wherein the dryer (4) is provided with at least one burner (5) generating drying heat for the materials to be treated by means of at least one flame (49) of the at least one burner (5), obtaining treated materials, a first suction system (16) of hot air from said dryer (4), a mixer (14) for mixing at least the treated materials, a control unit (18). The materials to be treated include inert lithic materials and materials containing bitumen, bituminous conglomerates or recycled bituminous material or mixed materials containing at least one part of materials containing bitumen. The dryer (4) consists of at least one first dryer portion (4') and of a second dryer portion (4") which are arranged one after the other with the interposition of a hot air passage compartment (22) between the first dryer portion (4') and the second dryer portion (4"), wherein the first dryer portion (4') is provided with said burner (5) generating drying heat for the materials present within the first dryer portion (4') and wherein said first suction system (16) of hot air sucks hot air from said dryer (4) with the establishment of a hot airflow oriented from the first dryer portion (4') provided with the burner (5) towards the second dryer portion (4"). The first dryer portion (4') provided with the burner (5) constitutes a combustion zone for the production of hot air of said hot airflow oriented from the first dryer portion (4') provided with the burner (5) towards the second dryer portion (4"). The second dryer portion (4") is devoid of a respective burner intended for the generation of heat for drying the materials present within the second dryer portion (4"), the whole drying heat of the materials present within the second dryer portion (4") being generated by means of said burner (5) of the first dryer portion (4') which is transferred to the second dryer portion (4") by means of the hot airflow oriented from the first dryer portion (4') provided with the burner (5) towards the second dryer portion (4"). The first dryer portion (4') constitutes the drying and heating portion for the inert lithic materials and the second dryer portion (4") constitutes the drying and heating portion for the materials containing bitumen, bituminous conglomerates or recycled bituminous material or mixed materials containing at least one part of materials containing bitumen. The flame (49) of the burner (5) of the first dryer portion (4') is oriented according to a direction of the flame (49) which is opposite with respect to the direction of advancement (27) of the material within the first dryer portion (4') and furthermore the hot airflow from the first dryer portion (4') provided with the burner (5) towards the second dryer portion (4") is oriented in countercurrent with respect to the direction of advancement (27) of the material within the first dryer portion (4') and with respect to the direction of advancement (28) of the material within the second dryer portion (4"). Therefore, the dryer (4) as a whole consists of the first dryer portion (4') and of the second dryer portion (4") and is provided with the burner (5) which preferably is the one and only burner of the dryer (4) as a whole.

The plant (1) for the production and distribution of bituminous conglomerates comprises adjustable deviation means (32, 33) for the deviation or for the adjustment of the quantity of said hot airflow oriented from the first dryer portion (4') provided with the burner (5) towards the second dryer portion (4"). The hot air passage compartment (22) between the first dryer portion (4') and the second dryer portion (4") consists of a deviation compartment for the hot airflow comprising:

- an inlet for hot air from the first dryer portion (4');
- a first outlet for hot air from inside the deviation compartment towards the second dryer portion (4"), the second dryer portion (4") being connected to the first suction system (16) of hot air for the establishment of said hot airflow oriented from the first dryer portion (4') provided with the burner (5) towards the second dryer portion (4");
- a second outlet for hot air from inside the deviation compartment towards a suction conduit (21) connected to the first suction system (16) of hot air for the establishment of a secondary airflow from the first dryer portion (4') towards the first suction system (16) without crossing the second dryer portion (4").

The adjustable deviation means (32, 33) can comprise a first shutter (32) which is settable on at least three positions of which:

- a first position (FIG. 9) in which the first shutter (32) leaves completely free the hot airflow towards the second dryer portion (4"), that is to say, it leaves completely open the outlet for hot air from the second dryer portion (4"), in which all the hot air sucked from the first dryer portion (4') is conveyed towards the second dryer portion (4");
- a second position (FIG. 8) in which the first shutter (32) completely blocks the hot airflow towards the second dryer portion (4"), that is to say, it completely shuts the outlet for hot air from the second dryer portion (4") in which all the hot air sucked from the first dryer portion (4') is conveyed towards the suction conduit (21) without crossing the second dryer portion (4");

a third position (FIG. 10) in which the first shutter (32) leaves partially free the hot airflow towards the second dryer portion (4"), that is to say, it leaves at least partially open the outlet for hot air from the second dryer portion (4"), with the partialization of the hot air sucked from the first dryer portion (4') between the second dryer portion (4") and the suction conduit (21).

The suction conduit (21) is provided with said adjustable deviation means (32, 33) in the form of a second shutter (33) for adjusting the quantity of hot air constituting said secondary airflow from the first dryer portion (4') towards the first suction system (16) without crossing the second dryer portion (4"), the second shutter (33) being settable on at least three positions of which:

a first position in which the second shutter (33) completely shuts the suction conduit (21);

a second position in which the second shutter (33) leaves completely free the airflow within the suction conduit (21);

a third position in which the second shutter (33) partially shuts the suction conduit (21).

The description of the present invention has been made with reference to the enclosed figures in a preferred embodiment, but it is evident that many possible changes, modifications and variations will be immediately clear to those skilled in the art in the light of the previous description. Thus, it must be underlined that the invention is not limited to the previous description, but it includes all the changes, modifications and variations in accordance with the appended claims.

NOMENCLATURE USED

With reference to the identification numbers in the enclosed figures, the following nomenclature has been used:

1. Plant
2. First dryer
3. Second dryer
4. Dryer
4' First dryer portion
4". Second dryer portion
5. Burner
6. Filter
7. Truck or road transport vehicle
8. First elevator or elevator of inert materials
9. Sieve
10. Buffer means or hoppers under the sieve
11. First weighing means for recycled material
12. Second elevator or elevator of recycled material
13. Second weighing means for filler and bitumen
14. Mixer
15. Fume evacuation means
16. First suction system
17'. First cochlea device
17". Second cochlea device
18. Control unit
19. Hopper under the filter
20. Pre-separation device
21. Suction conduit
22. Air deviation compartment or air passage compartment
23. Deposit means of treated recycled material or RAP
24. Third weighing means for virgin aggregates
25. First feeding device or primary feeding device
26. Second feeding device or secondary feeding device
27. Direction of advancement in the first portion
28. Direction of advancement in the second portion
29. Third deposit means for filler
30. First suction connection
31. Exhaust or chute for virgin aggregates
32. First shutter
33. Second shutter
34. Circumferential opening
35. Storage means
36. Damping system of polluting compounds
37'. First drawing means
37". Second drawing means
38. Second suction connection
39. Second suction system
40. Introduction means
41. Filtering device
42. Third elevator or elevator of filling material or filler
43. Passage
44. Finning
45. First chamber
46. Second chamber
47. Pre-chamber
48. Deflector or section reducer
49. Flame

The invention claimed is:

1. A system for production and distribution of bituminous conglomerates, the system comprising:

at least one dryer adapted to dry materials to be treated, said at least one dryer having a burner adapted to generate heat for the materials to be treated, the burner having at least one flame;

a first suction system cooperative with said at least one dryer so as to suck in hot air from said at least one dryer;

a mixer adapted to mix treated materials;

a control unit, wherein said at least one dryer has at least one first dryer portion and a second dryer portion arranged one after another with a hot air passage compartment between the at least one first dryer portion and the second dryer portion such that the material advances within the at least one first dryer portion along a first direction of advancement within the at least one first dryer portion and in which the material advances within the second dryer portion along a second direction of advancement, wherein the at, least one first dryer portion has the burner therein so as to dry the material in the at least one first dryer portion, wherein said first suction system draws the hot air from the at least one first dryer portion toward the second dryer portion, said at least one dryer comprising:

an adjustable deviator adapted to adjust a quantity of the hot air from the at least one first dryer portion to the second dryer portion, wherein the at least one first dryer portion has a pair of zones in which a first zone of the pair of zones constitutes a first combustion chamber in which the at least one flame develops, the pair of zones having a second zone, the second zone being a drying chamber, the at least one first dryer portion having a passage integral therewith, the passage communicating between first combustion chamber of the at least one first dryer portion and the second dryer portion, wherein the at least one first dryer portion has a supply conduit of the hot air, the supply conduit extending toward the second dryer portion.

2. The system of claim 1, wherein the passage has a diameter approximately one-third of an external diameter of the at least one first dryer portion.

3. The system of claim 1, wherein the passage has a length of between one-third and two-thirds of a length of the drying chamber of the second zone of the at least one first dryer portion.

4. The system of claim 1, wherein the passage has an adjustable finning adapted to adjust a rate of the hot air flow.

5. The system of claim 1, wherein the at least one first dryer portion is adapted to dry and heat inert lithic materials, wherein the second dryer portion is adapted to dry and heat materials containing bitumen or the bituminous conglomerates or recycled bituminous material or mixtures thereof.

6. The system of claim 1, wherein the at least one first dryer portion has a combustion zone for producing the hot air of the hot airflow and oriented from the at least one first dryer portion toward the second dryer portion.

7. The system of claim 1, wherein the second dryer portion is devoid of a burner such that an entire drying heat for material in the second dryer portion is provided by the burner of the at least one first dryer portion.

8. The system of claim 1, wherein the at least one flame of the at least one first dryer portion is oriented in a direction opposite to the first direction of advancement of the material of the at least one first dryer portion, wherein the hot airflow from the at least one first dryer portion is oriented countercurrent to the first direction of advancement in the at least one first dryer portion and the second direction of advancement in the second dryer portion.

9. The system of claim 1, wherein the burner is only a single burner.

10. The system of claim 9, wherein the only single burner has a rated power no more than twenty-four megawatts.

11. The system of claim 1, wherein the hot air passage compartment comprises;

an inlet adapted to receive the hot air from the at least one first dryer portion;

a first outlet adapted to pass hot air toward the second dryer portion, the second dryer portion being connected to said first suction system;

a second outlet communicating with a suction conduit connected to said first suction system and adapted to provide a secondary airflow from the at least one first dryer portion toward said first suction system without crossing the second dryer portion, wherein the adjustable deviator comprises a first shutter, the first shutter being settable between at least three positions in which a first position of the three positions has the first shutter allowing free flow of the hot airflow toward the second dryer portion in which all of the hot air sucked from the at least one first dryer portion is conveyed toward the second dryer portion, a second position of the at least three positions has the first shutter completely blocking the airflow toward the second dryer portion in which all of the hot air sucked from the at least one first dryer portion is conveyed to the suction conduit without crossing the second dryer portion, a third position of the at least three positions has the first shutter partially frees the hot air toward the second dryer portion.

12. The system of claim 11, wherein said adjustable deviator has a second shutter adapted to adjust a quantity of the hot air of the secondary airflow from the at least one first dryer portion toward said first suction system without crossing the second dryer portion, the second shutter being settable between at least three positions in which a first position of the second shutter completely shuts the suction conduit, a second position of the second shutter completely frees the airflow withing the second conduit, a third position of the second shutter partially shuts the suction conduit.

13. The system of claim 1, wherein the combustion chamber has containment blades.

14. The system of claim 1, wherein the at least one first dryer portion comprises:

a first feeding device; and a second feeding device, said first feeding device and said second feeding device adapted to introduce the materials into the at least one first dryer portion, wherein said first feeding device communicates with a first series of upstream circumferential openings, wherein said second feeding device communicates with a second series of downstream openings, the first feeding device and the first series of upstream circumferential openings being positioned in correspondence to or adjacent to a head end of the at least one first, dryer portion, said second feeding device and the second series of downstream openings being spaced apart with respect to said first feeding device, said second feeding device being positioned in correspondence to or adjacent to a position between the head end of the at least one first dryer portion and an outlet end of the at least one first dryer portion.

15. The system of claim 14, wherein said first feeding device and the first series of upstream circumferential openings are spaced apart with respect to said second feeding device and the second series of downstream openings by a distance of between 25% and 75% of an overall length of the second drying chamber.

16. The system of claim 1, further comprising:

a first gravity conveyor adapted to convey the treated materials toward a deposit area, said first gravity conveyor being devoid of a heater, wherein the at least one dryer is positioned on an upper part of a sieve so as to divide inert lithic materials in correspondence to a size of the inert lithic materials; and a second gravity conveyor adapted to direct the inert lithic material toward the sieve.

17. The system of claim 1, further comprising:

a recirculator adapted to recirculate gases from a separation compartment of a pre-separation device toward the at least one first dryer portion.

18. The system of claim 1, further comprising:

a damping system, the at least one first dryer portion being connected to said damping system, the damping system comprising:

a generator adapted to generate an airflow containing polluting compounds from the system; and an introducer adapted to introduce the airflow containing the polluting compounds in the at least one first dryer portion, the at least one first dryer portion having a deviation device adapted to deviate the airflow containing the polluting compounds toward a perimetrically external surface of the at least one first dryer portion, the deviation device adapted to move the airflow from the at least one flame, the deviation device adapted to create a turbulence in the airflow withing the at least one first dryer portion.

19. The system of claim 18, wherein said generator is settable between at least four suction positions, a first position of the at least four suction positions corresponding to a loading station so as to define a first suction device, a second suction position of the at least four suction positions corresponding to a device for production of bituminous conglomerates so as to define a second suction device, a third suction position of the at least four suction positions being in correspondence with a mixer, a fourth suction position of the at least four suction positions corresponding to a cover hood of a transport zone of the bituminous conglomerates, the cover hood having a third suction device.

20. The system of claim 18, wherein the deviation device is configured to convey the airflow of the polluting compounds in a conveying direction oriented in a direction in which a direction of the at least one flame is oriented.

21. The system of claim 18, wherein said control unit is adapted to adjust a combustion temperature for the polluting compounds in the airflow of polluting compounds, the combustion temperature being greater than 400° C.

22. The system of claim 18, wherein said control unit controls said generator so as to adjust the airflow containing the polluting compounds to a range from 1000 $Nm^3/h$ to 20,000 $Nm^3/h$ of air with a constant flow rate, wherein $Nm^3/h$ refers to a measurement of the flow rate at one atmosphere and 20° C.

23. The system of claim 14, wherein said control unit is switchable between at least three operating modes, a first operating mode of the at least three operating modes has the burner producing heat for both treatment of materials in the at least one first dryer portion and for treatment of materials in the second dryer portion, a second operating mode of the at least three operating modes has the burner producing heat only for treatment of materials in the at least one first dryer portion, a three operating mode of the at least three operating modes has the burner producing heat only for treatment of materials in the second dryer portion.

24. The system of claim 23, wherein said control unit is in the first operating mode or the third operating mode, said adjustable deviator deviates or adjusts the quantity of hot airflow oriented from the at least one first dryer portion toward the second dryer portion so that a temperature of the hot airflow from the second dryer portion is greater than 100° C.

25. The system of claim 23, wherein said control unit in the first operating mode or the third operating mode causes said adjustment deviator to deviate onto adjust the quantity of hot airflow oriented from the at least one first dryer portion toward the second dryer portion so that a temperature of the hot airflow at an inlet of the second dryer portion is between 500° C. and 600° C.

26. The system of claim 23, wherein said control unit controls said first feeding device and said second feeding device such that said first feeding device feeds the materials to the at least one first dryer portion and such that said second feeding device feeds materials within the at least one first dryer portion according to a temperature detected in the second dryer portion.

* * * * *